US008322835B2

(12) United States Patent
Aoki et al.

(10) Patent No.: US 8,322,835 B2
(45) **Date of Patent: *Dec. 4, 2012**

(54) SEALING STRUCTURE OF FLUID CONTAINER, AND METHOD OF MANUFACTURING AND REUSING FLUID CONTAINER

(75) Inventors: Yuji Aoki, Matsumoto (JP); Hitotoshi Kimura, Matsumoto (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 800 days.

This patent is subject to a terminal disclaimer.

(21) Appl. No.: 12/033,394

(22) Filed: Feb. 19, 2008

(65) Prior Publication Data

US 2008/0198211 A1 Aug. 21, 2008

(30) Foreign Application Priority Data

Feb. 19, 2007 (JP) ..... 2007-037993
May 18, 2007 (JP) ..... 2007-132728
Jul. 9, 2007 (JP) ..... 2007-179755

(51) Int. Cl.
*B41J 2/175* (2006.01)

(52) U.S. Cl. ..... 347/86; 347/85

(58) Field of Classification Search ..... 347/86
See application file for complete search history.

(56) References Cited

U.S. PATENT DOCUMENTS 2,076,668 A 4/1937 Read
3,550,616 A 12/1970 Graham
3,599,538 A 8/1971 Piazze
3,941,171 A 3/1976 Ogle
4,020,978 A 5/1977 Szczepanski
4,479,989 A 10/1984 Mahal
4,689,640 A 8/1987 Shimomura
4,716,183 A 12/1987 Gamarra et al.
4,762,514 A 8/1988 Yoshida
4,928,126 A 5/1990 Asai
4,977,413 A 12/1990 Yamanaka et al.
5,116,902 A 5/1992 Chapman et al.

(Continued)

FOREIGN PATENT DOCUMENTS

BR 8802880 A 1/1990

(Continued)

OTHER PUBLICATIONS

Final Office Action dated Jun. 16, 2011, issued in related U.S. Appl. No. 12/033,501.

*Primary Examiner* — Matthew Luu
*Assistant Examiner* — Renee I Wilson
(74) *Attorney, Agent, or Firm* — Sughrue Mion, PLLC

(57) ABSTRACT

The invention provides a fluid-outlet-section sealing structure that includes: a fluid outlet section, a sealing member, and a sealing film. The fluid outlet section has a fluid flow channel and an open-end surface. The open-end surface of the fluid outlet section is formed at a fluid outlet end of the fluid flow channel of the fluid outlet section. The sealing member is provided in the fluid flow channel of the fluid outlet section. The sealing film is provided to cover the fluid flow channel of the fluid outlet section and the open-end surface of the fluid outlet section. The sealing film is thermally adhered to the open-end surface of the fluid outlet section and the sealing member.

21 Claims, 12 Drawing Sheets

U.S. PATENT DOCUMENTS

| | | | | | |
|---|---|---|---|---|---|
| 5,158,499 | A | | 10/1992 | Guckenberger | |
| 5,216,449 | A | | 6/1993 | English | |
| 5,477,963 | A | * | 12/1995 | Mochizuki et al. | 206/701 |
| 5,563,637 | A | | 10/1996 | Francis et al. | |
| 5,610,238 | A | | 3/1997 | Himes et al. | |
| 5,640,186 | A | | 6/1997 | Swanson et al. | |
| 5,657,058 | A | | 8/1997 | Mochizuki et al. | |
| 5,734,401 | A | | 3/1998 | Clark et al. | |
| 5,754,207 | A | | 5/1998 | Gragg et al. | |
| 5,875,615 | A | | 3/1999 | Ito et al. | |
| 6,017,332 | A | | 1/2000 | Urrutia | |
| 6,033,141 | A | | 3/2000 | Blaustein et al. | |
| 6,102,535 | A | | 8/2000 | Papenfuhs et al. | |
| 6,106,112 | A | | 8/2000 | Okubo et al. | |
| 6,130,696 | A | * | 10/2000 | Mashita et al. | 347/86 |
| 6,149,256 | A | | 11/2000 | McIntyre et al. | |
| 6,164,770 | A | | 12/2000 | Takata | |
| 6,172,694 | B1 | | 1/2001 | Droege et al. | |
| 6,183,077 | B1 | | 2/2001 | Hmelar et al. | |
| 6,264,314 | B1 | | 7/2001 | Mochizuki et al. | |
| 6,267,474 | B1 | | 7/2001 | Mochizuki | |
| 6,312,115 | B1 | * | 11/2001 | Hara et al. | 347/86 |
| 6,375,316 | B1 | | 4/2002 | Okubo et al. | |
| 6,422,691 | B2 | | 7/2002 | Kobayashi et al. | |
| 6,505,924 | B2 | | 1/2003 | Shimizu | |
| 6,554,412 | B1 | * | 4/2003 | Seino et al. | 347/86 |
| 6,582,068 | B2 | | 6/2003 | Ishizawa et al. | |
| 6,585,359 | B1 | | 7/2003 | Gasvoda et al. | |
| 6,666,551 | B2 | | 12/2003 | Kobayashi et al. | |
| 6,746,111 | B2 | | 6/2004 | Thielman et al. | |
| 6,786,581 | B1 | | 9/2004 | Shinada et al. | |
| 6,843,558 | B2 | | 1/2005 | Seino | |
| 6,854,834 | B2 | | 2/2005 | Hara et al. | |
| 6,886,927 | B2 | | 5/2005 | Shinada et al. | |
| 6,908,182 | B2 | | 6/2005 | Nakazawa et al. | |
| 7,152,965 | B2 | | 12/2006 | Ishizawa et al. | |
| 7,384,133 | B2 | | 6/2008 | Ishizawa et al. | |
| 7,658,480 | B2 | | 2/2010 | Uehara et al. | |
| 7,967,428 | B2 | | 6/2011 | Seino et al. | |
| 2001/0040613 | A1 | | 11/2001 | Nakazawa et al. | |
| 2002/0089576 | A1 | | 7/2002 | Ishizawa et al. | |
| 2002/0196312 | A1 | | 12/2002 | Ishizawa et al. | |
| 2003/0038867 | A1 | | 2/2003 | Yamamoto et al. | |
| 2003/0156175 | A1 | | 8/2003 | Blease et al. | |
| 2004/0056934 | A1 | | 3/2004 | Seino | |
| 2004/0217127 | A1 | | 11/2004 | Kimura et al. | |
| 2004/0252146 | A1 | | 12/2004 | Naka et al. | |
| 2005/0041079 | A1 | * | 2/2005 | Saito | 347/86 |
| 2005/0062811 | A1 | * | 3/2005 | Ishizawa et al. | 347/86 |
| 2005/0179751 | A1 | * | 8/2005 | Seino et al. | 347/86 |
| 2006/0017755 | A1 | * | 1/2006 | Shinada | 347/7 |
| 2006/0181584 | A1 | | 8/2006 | Nip | |
| 2008/0239039 | A1 | | 10/2008 | Ishizawa et al. | |
| 2010/0265303 | A1 | | 10/2010 | Uehara et al. | |
| 2011/0134197 | A1 | | 6/2011 | Ishizawa et al. | |

FOREIGN PATENT DOCUMENTS

| | | | | |
|---|---|---|---|---|
| EP | 0498117 | A2 | | 8/1992 |
| EP | 0585615 | A2 | | 3/1994 |
| EP | 0627317 | A1 | | 12/1994 |
| EP | 0709207 | A2 | | 5/1996 |
| EP | 0715958 | A2 | | 6/1996 |
| EP | 0761450 | A2 | | 3/1997 |
| EP | 0778145 | A1 | | 6/1997 |
| EP | 0841174 | A2 | | 5/1998 |
| EP | 0847866 | A2 | | 6/1998 |
| EP | 0861733 | A2 | | 9/1998 |
| EP | 1380428 | A2 | | 1/2004 |
| GB | 2279041 | A | | 12/1994 |
| GB | 2315461 | A | | 2/1998 |
| JP | 50074341 | A | | 6/1975 |
| JP | 63009546 | A | | 1/1988 |
| JP | 63011343 | A | | 1/1988 |
| JP | 04-135862 | A | | 5/1992 |
| JP | 5229137 | A | | 9/1993 |
| JP | 6226992 | A | | 8/1994 |
| JP | 6328715 | A | | 11/1994 |
| JP | 7251873 | A | | 10/1995 |
| JP | 8104717 | A | | 4/1996 |
| JP | 9174876 | A | | 7/1997 |
| JP | 09-240005 | A | | 9/1997 |
| JP | 63161057 | A | | 7/1998 |
| JP | 10258518 | A | | 9/1998 |
| JP | 10510306 | T | | 10/1998 |
| JP | 11092677 | A | | 4/1999 |
| JP | 2000-203054 | A | | 7/2000 |
| JP | 2000203054 | A | * | 7/2000 |
| JP | 2001-212973 | A | | 8/2001 |
| JP | 2001212974 | A | | 8/2001 |
| JP | 2002192739 | A | | 7/2002 |
| JP | 2003-331879 | A | | 11/2003 |
| JP | 2005-059322 | A | | 3/2005 |
| JP | 2005-225164 | A | | 8/2005 |
| JP | 2006-175856 | A | | 7/2006 |
| JP | 2006-264067 | A | | 10/2006 |
| JP | 2007-038537 | A | | 2/2007 |
| WO | 9617885 | A1 | | 6/1996 |
| WO | 9700294 | A1 | | 1/1997 |

* cited by examiner

SEALING STRUCTURE OF FLUID CONTAINER, AND METHOD OF MANUFACTURING AND REUSING FLUID CONTAINER

BACKGROUND

1. Technical Field

The present invention relates to a new or refilled fluid container and manufacturing or reusing the fluid container each of which can be suitably applied to, for example, an ink cartridge for a printer, though not limited thereto.

2. Related Art

In the technical field to which the invention pertains, though not limited thereto, an ink-jet printer is known as one example of a variety of liquid ejecting apparatuses that ejects liquid drops from the nozzles of a liquid ejecting head. Some of ink-jet printers have "off-carriage" ink supply systems. In the configuration of off-carriage-type ink-jet printers, ink cartridges are detachably attached to attachment positions that are not provided on a carriage. Such an off-carriage-type ink supply system is adopted, for example, in a case where each of ink cartridges is required to have a relatively large volume because a printer is dedicated to large-sized paper printing. As another non-limiting example thereof, an off-carriage-type ink supply system is advantageously adopted so as to reduce the size of a carriage with no ink cartridges mounted thereon, thereby reducing the size of a printer and achieving a slim body thereof.

As a non-limiting example of the attachment positions mentioned above, each of ink cartridges is attached to a main-body-side receptacle of an ink-jet printer having an off-carriage-type ink supply system. Ink is supplied from the ink cartridge via an ink supply tube to, for example, a sub tank that is provided in a carriage. These days, there is an increasing demand for high-speed and finer-dot printing. Accordingly, the amount of ink that flows through the ink supply tube is on the rise. As the amount of ink that flows through the ink supply tube increases, so does the stagnation pressure of ink inside the ink supply tube. As a result of the increase in the stagnation pressure of ink, the actual amount of ink that is supplied to the sub tank decreases, which is an undesirable phenomenon.

In an effort to provide a technical solution to such a problem, JP-A-2001-212973 discloses an ink cartridge that is capable of forcibly "pumping" ink out of an ink pack. Specifically, the ink cartridge described in JP-A-2001-212973 has an ink pack, which is a bag that contains ink, inside the case thereof. Air is taken into an inner space between the ink cartridge case and the ink pack. As the ink pack is pressurized, ink contained therein is forcibly pressed out of the ink pack.

An ink outlet member is connected to the ink pack. The ink outlet member has a valve mechanism. The ink cartridge case has an opening through which the ink outlet member is exposed to the outside. A sheet of sealing film is adhered to an end surface of the ink outlet member and a peripheral region of the ink cartridge case around the opening by means of a thermal adhesion technique so as to form a liquid-tight structure. An example of such a liquid-tight structure is described in JP-A-2005-59322 (among others, refer to FIG. 5 thereof).

The ink outlet member has an ink flow channel (i.e., ink passage) inside thereof. A sealing member, a valve member, and a coil spring (i.e., helical spring) are provided in the ink flow channel. The sealing member is made of an elastic ring. The sealing member is in tight contact with the inner wall of the ink flow channel. The valve member is movable and can become in contact with the sealing member. The coil spring applies a pressing force to the valve member so that the valve member is pressed against (i.e., contacts) the sealing member. When an ink take-out needle (e.g., an hollow needle which takes ink therein and supplies the ink to a print head) is inserted through the sealing film, the ink take-out needle enters the ink flow channel. Before the ink take-out needle is inserted through the sealing film so as to enter the ink flow channel, the sealing member functions as a valve seat member that blocks off the ink flow channel because the coil spring urges the valve member so that the valve member is pressed against the sealing member. When the ink take-out needle pierces through the sealing film so as to enter the ink flow channel, the valve member comes away from the sealing member against the urging force applied from the coil spring thereto because the ink take-out needle presses the valve member away from the sealing member. As a result thereof, the ink flow channel, which had been blocked before the ink take-out needle was inserted through the sealing film, becomes cleared.

After the ink flow channel is opened, it is required that ink should flow only through an ink conduit that is formed inside the ink take-out needle. In order to ensure that ink flows only through the ink conduit that is formed inside the ink take-out needle, in the configuration of the related art, the sealing member, which is made of an elastic ring as explained above, provides elastic sealing between the ink take-out needle and the sealing member as well as between the sealing member and the inner wall of the ink flow channel.

Disadvantageously, however, if the precision in the actual circularity of the ink flow channel of the ink outlet member is poor, or in other words, if the margin of errors in the actual roundness of the ink flow channel of the ink outlet member is large, it is practically impossible, or at best difficult, to provide perfect sealing between the sealing member and the inner wall of the ink flow channel. As a consequence thereof, the leakage of ink occurs. In addition, in a case where the configuration disclosed in the first-mentioned unexamined patent application publication (JP-A-2001-212973), which applies a pressure to the ink pack so as to pump out ink in a forcible manner, is adopted, there is an additional risk that pressure-supplied ink breaks (i.e., unseals) the elastic sealing between the sealing member and the inner wall of the ink flow channel if the elastic sealing provided therebetween is not at a sufficiently reliable liquid-tight level. In addition to the above-described case, there is a possibility that the elastic sealing between the sealing member and the inner wall of the ink flow channel could be broken temporarily if the ink cartridge is inadvertently dropped or if any unexpected vibration is applied to the ink cartridge from the outside.

It should be noted that the above-identified problem is not unique to the ink cartridge. That is, the same problem also arises in a variety of other applications in which elastic sealing is provided between a sealing member and the inner wall of a fluid flow channel that is formed in a fluid outlet member. For example, regardless of whether it has an off-carriage-type ink supply system or an on-carriage-type ink supply system, a typical printer has the same kind of ink outlet members as that described above at a plurality of connection portions of the ink flow channel thereof. The same sealing structure as that described above is adopted in a liquid fuel outlet member provided in a liquid fuel cartridge as described in JP-A-2003-331879 (among others, refer to FIG. 5 thereof). Moreover, in addition to those of printers, the same sealing structure as that described above could be adopted in a variety of connection portions of the fluid flow channels that encompass both liquid and gas flow channels.

SUMMARY

An advantage of some aspects of the invention is to provide structures of new or refilled fluid containers and methods for manufacturing or refilling the fluid containers, each of which makes it possible to securely prevent a fluid from leaking through a gap between the inner wall of a fluid flow channel formed in a fluid outlet section and a sealing member without any substantial risk of unsealing thereof and without recourse to elastic sealing provided between the inner wall of the fluid flow channel formed in the fluid outlet section and the sealing member. In the context of this specification as well as the recitation of appended claims, the term "fluid" encompasses both liquid and gas.

As a first preferred aspect of this invention, a fluid container comprises: a fluid-containing bag containing fluid; a fluid outlet section being communicated with the fluid-containing bag, the fluid outlet section having a fluid flow channel and an open-end surface, the open-end surface being formed at a fluid outlet end of the fluid flow channel; a sealing member provided in the fluid flow channel; and a sealing film covering the fluid flow channel and the open-end surface, the sealing film being thermally adhered to the open-end surface of the fluid outlet section and the sealing member.

According to the first aspect of the invention, a thermally adhered sealing film provides a sealing to a gap between the inner wall of the fluid flow channel and the outer wall of the sealing member. Therefore, even in a case where the precision in the actual circularity of the fluid flow channel of the fluid outlet section is poor, or in other words, even in a case where the margin of errors in the actual roundness of the fluid flow channel of the fluid outlet section is large, it is possible to prevent the leakage of the fluid without recourse to sealing provided between the inner wall of the fluid flow channel of the fluid outlet section and the sealing member. In addition, even in a case where the sealing between the sealing member and the inner wall of the fluid flow channel is broken temporarily because the fluid outlet section is inadvertently dropped or because any unexpected vibration is applied to the fluid outlet section from the outside, the thermally adhered sealing film ensures that the leakage of the fluid does not occur.

In the first aspect of the invention, it is preferable that the fluid flow channel admits a fluid take-out needle to enter the fluid flow channel with piercing the sealing film, and the sealing member comprises an elastic ring that has a hole portion through which the fluid take-out needle is inserted in tight contact therewith. In such the preferred configuration, it is just enough that the sealing material made of an elastic ring exerts a sealing property between the outer wall of the fluid take-out needle and the sealing member itself, when the sealing material tight fits to the outer wall of the needle.

In the preferred configuration described above, the fluid container may further comprises: a movable valve member that is provided in the fluid flow channel, the movable valve member contacting with the sealing member when the fluid take-out needle is not inserted into the fluid flow channel; and an urging member that urges the valve member to press the valve member against the sealing member. In such the preferred configuration, the sealing member may functions as a valve seat member that blocks the fluid flow channel when the fluid take-out needle is not inserted into the fluid flow channel. When the fluid take-out needle is inserted into the fluid flow channel, the valve member may be pressed by the fluid take-out needle and comes away from the sealing member against the urging force applied from the urging member thereto so that the fluid flow channel is opened.

In the first aspect of the invention, it is preferable that the open-end surface includes a first adhesion allowance portion that protrudes in a ring shape, the sealing member includes a second adhesion allowance portion that protrudes in a ring shape, and the first adhesion allowance portion and the second adhesion allowance portion are thermally adhered to the sealing film. In such the preferred configuration, it is possible to limit melting regions. This makes it further possible to complete thermal adhesion work with comparatively small pressure in a comparatively short time period. Moreover, it is possible to visually judge when the ongoing thermal adhesion work should be ended or not on the basis of the melting state of the first adhesion allowance portion and the second adhesion allowance portion, for example, whether they have already melted away or not. Therefore, it is possible to make the quality of thermal adhesion uniform.

In the first aspect of the invention, it is preferable that an outer surface of the sealing member contacts an inner-wall surface of the fluid flow channel so that a position of the sealing member is determined to the fluid flow channel.

This preferred configuration eliminates the need of a sealing between the sealing member and the fluid flow channel. It is just enough that the positions of the sealing member and the fluid flow channel are reliably determined with respect to each other. As an advantageous effect of the positional determination of the sealing member, it is possible to uniformize the positions of the sealing members at the time when they are subjected to a thermal adhesion process among a plurality of components. Therefore, it is possible to reduce defective fraction in production.

In the first aspect of the invention, it is preferable that the fluid outlet section, the sealing member, and the sealing film comprise a polyolefin material. A polyolefin material possesses high reliability as a material even when it is exposed to fluid such as ink. If the same single material is adopted therefor, it is possible to ensure reliable thermal adhesion.

In the preferred configuration described above, the polyolefin material may be polypropylene or polyethylene each of which possesses, among others, high reliability as a material even when it is exposed to fluid such as ink. The inventors found a sealing material that can be thermally adhered to these materials with an excellent thermal adhesion property, which is the origin of the invention.

In the preferred configuration described above, the sealing film comprises a plurality of layers of different materials, and an outermost layer of the plurality of layers, that faces the fluid outlet section and the sealing member, is made of the polyolefin material. With such the configuration, it is possible to ensure that the sealing film has another property that differs from the property of the thermal adhesion layer without sacrificing its excellent thermal adhesion property. For example, the adjacent layer that is adjacent to the outermost layer may be made of a material that has a melting point higher than that of the polyolefin material. With such the configuration, the sealing film can retain its shape even after it is subjected to a thermal adhesion process because the adjacent layer thereof does not melt at a certain temperature at which the outermost layer thereof melts. A few non-limiting examples of such a material are polyethylene terephthalate and polyimide.

In the preferred configuration described above, it is further preferable that the sealing film comprises a thermoplastic elastomer that contains the polyolefin material. The thermoplastic elastomer that contains the polyolefin material has an excellent thermal adhesion property with the polypropylene or polyethylene described above.

In the first aspect of the invention, it is preferable that the fluid container further comprises a case having a space into which the fluid-containing bag and the fluid outlet section are placed; a pressure application hole through which pressurization fluid is fed to press the fluid-containing bag and makes a fluid contained in the fluid-containing bag flow out; and an opening through which the open-end surface of the fluid outlet section is exposed. It is also preferable that the sealing film is thermally adhered further to the case at the periphery of the opening In such the configuration, it is possible to further seal the pressurization fluid by the sealing film as well as the fluid contained in the fluid-containing bag.

In the first aspect of the invention, it is preferable that the fluid container further comprises a fluid remaining amount detection unit disposed between the fluid-containing bag and the fluid flow-out section. It is also preferable that the fluid flow-out section being communicated with the fluid-containing bag via the fluid remaining amount detection unit. That is, a sealing structure according to an aspect of the invention is not limited to one that is directly communicated with a fluid-containing bag. A sealing structure according to an aspect of the invention may be communicated with a fluid-containing bag with interposing the fluid remaining amount detection unit therebetween.

In the first aspect of the invention, if at least a part of the sealing film has been broken, an overcoat film may be laid over and adhered to the sealing film to cover the part of the sealing film.

With such the structure, it is possible to recycle a used fluid container as a refilled fluid container while sealing property between the sealing film and the open-end surface as well as between the sealing film and the sealing member is retained. The recycle is achieved just by adhering, either thermally or non-thermally, an overcoat film onto the partially broken sealing film. The structure of the first aspect of the invention makes it possible to guarantee the commercial value of the refilled fluid container.

As the second preferred aspect of this invention, a method for manufacturing the fluid container according to first aspect of the invention, comprises steps of: inserting the sealing member into the fluid outlet section from a side of the open-end surface; after the step of inserting, providing the sealing film to cover the fluid flow channel and the open-end surface; and after the step of providing, thermally adhering the sealing film to the open-end surface of the fluid outlet section and the sealing member.

It is possible to carry out a thermal adhesion work easily with an enhanced reliability.

In the second aspect of the invention, it is preferable that, in the step of inserting, an outer surface of the sealing member contacts an inner-wall surface of the fluid flow channel so that a position of the sealing member is determined to the fluid flow channel. This preferred method eliminates the need of a sealing between the sealing member and the fluid flow channel. It is just enough that the positions of the sealing member and the fluid flow channel are reliably determined with respect to each other. As an advantageous effect of the positional determination of the sealing member, it is possible to uniformize the positions of the sealing members at the time when they are subjected to a thermal adhesion process among a plurality of components. Therefore, it is possible to reduce defective fraction in production.

As mentioned above, in the first aspect of the invention, it is preferable that the open-end surface includes a first adhesion allowance portion that protrudes in a ring shape, the sealing member includes a second adhesion allowance portion that protrudes in a ring shape, and the first adhesion allowance portion and the second adhesion allowance portion are thermally adhered to the sealing film. As the third preferred aspect of this invention, a method for manufacturing the fluid container according to such the preferred configuration, comprising the steps of: inserting the sealing member into the fluid outlet section from a side of the open-end surface, so that the first adhesion allowance portion and the second adhesion allowance portion are substantially on one plane; after the step of inserting, providing the sealing film to cover the fluid flow channel and the open-end surface; and after the step of providing, thermally melting the first and the second adhesion allowance portions and adhering to the sealing film. As has already been described above, such the method makes it possible to complete thermal adhesion work with comparatively small pressure in a comparatively short time period. Moreover, it is possible to visually judge when the ongoing thermal adhesion work should be ended or not on the basis of the melting state of the first adhesion allowance portion and the second adhesion allowance portion, for example, whether they have already melted away or not. Therefore, it is possible to make the quality of thermal adhesion uniform.

As mentioned above, in the first aspect of the invention, if at least a part of the sealing film has been broken, an overcoat film may be laid over and adhered to the sealing film to cover the part of the sealing film. As the fourth preferred aspect of this invention, a method for manufacturing the fluid container according to such the configuration, comprises the steps of; filling fluid into the fluid-containing bag though the broken sealing film; and after the step of filling, adhering an overcoat film to the sealing film.

With such the method, it is possible to recycle a used fluid container as a refilled fluid container while sealing property between the sealing film and the open-end surface as well as between the sealing film and the sealing member is retained. The recycle is achieved just by adhering, either thermally or non-thermally, an overcoat film onto the partially broken sealing film. The method of the fourth aspect of the invention makes it possible to guarantee the commercial value of the refilled fluid container.

BRIEF DESCRIPTION OF THE DRAWINGS

The invention will be described with reference to the accompanying drawings, wherein like numbers reference like elements.

FIG. 14A is an enlarged view that schematically shows, in a partial illustration, a circuit substrate and surrounding configuration thereof, whereas

DESCRIPTION OF EXEMPLARY EMBODIMENTS

First Embodiment

With reference to the accompanying drawings, exemplary embodiments of the present invention are explained in detail below. Although the invention is described below while explaining exemplary embodiments thereof, the specific embodiments described below are not intended to limit the scope of the invention recited in the appended claims and thus should be in no case understood to restrict thereof; nor is it always necessary to encompass all of features and/or a combination(s) thereof that are discussed in the following embodiments as means for solving the problem identified by the invention.

General Configuration of Fluid Ejecting Apparatus

Figure 1:
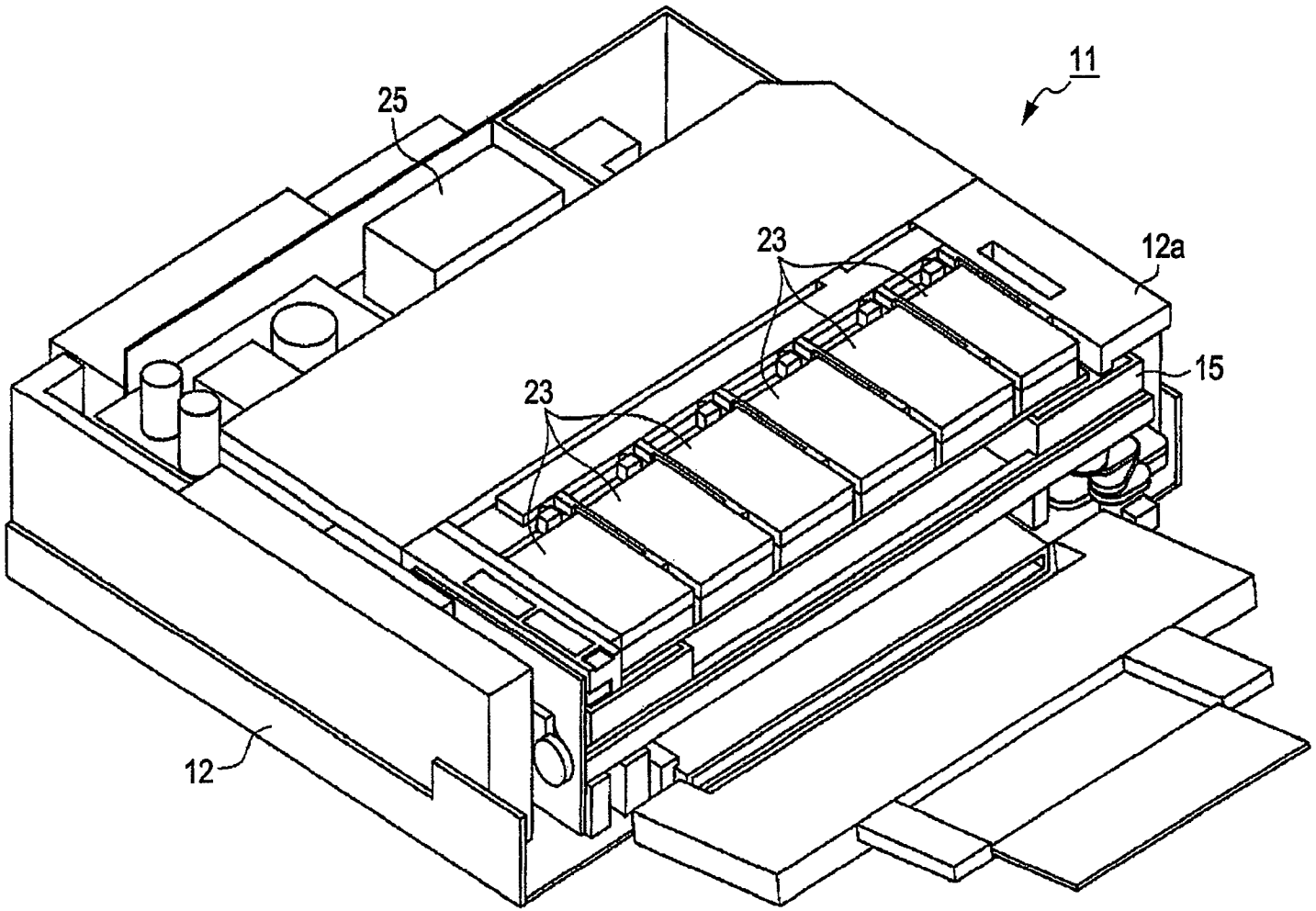
FIG. 1 is a perspective view that schematically illustrates an example of the configuration of a printer according to a first embodiment of the invention.
Figure 2:
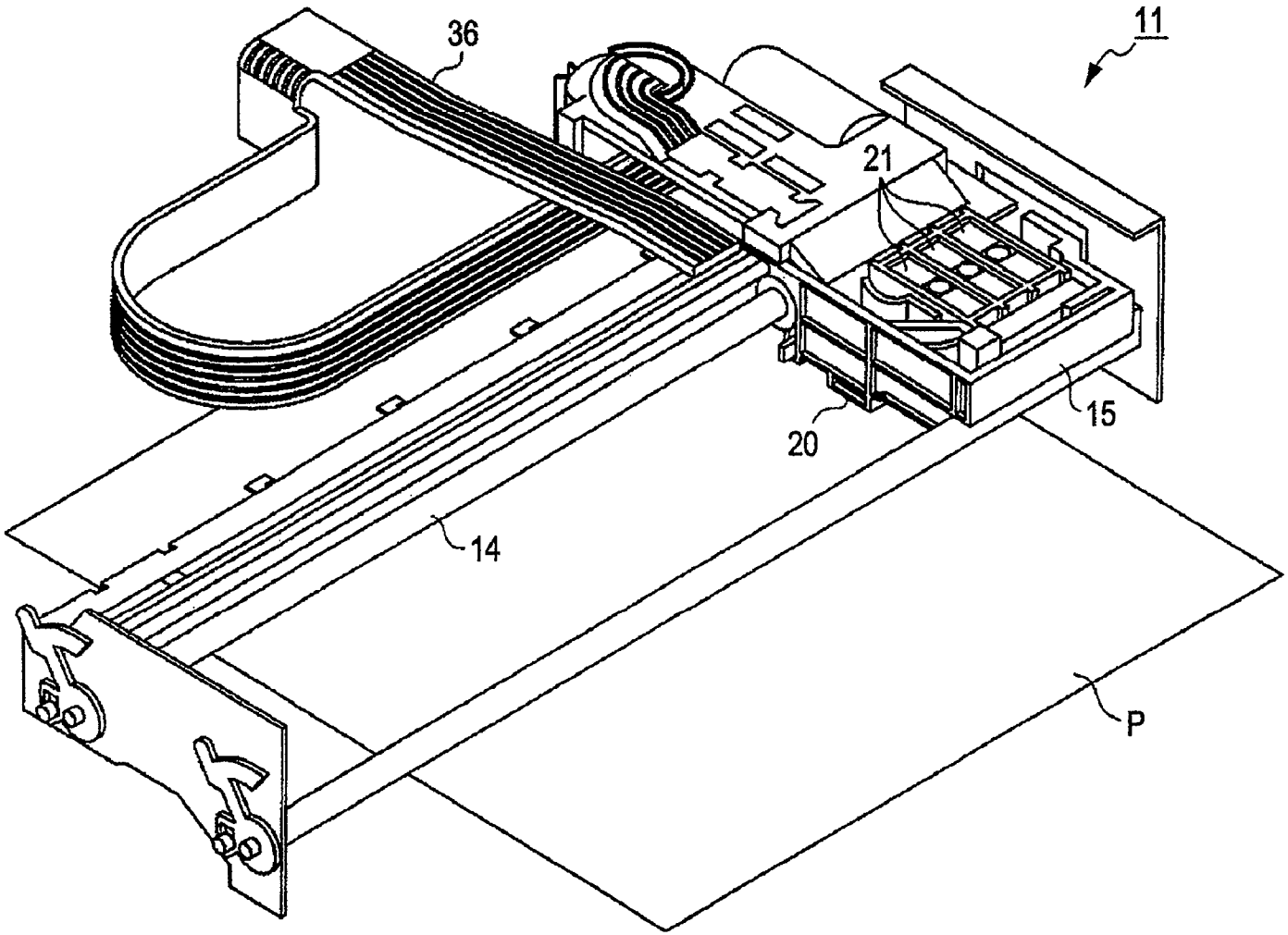
FIG. 2 is a perspective view that schematically illustrates an example of the configuration of the printer illustrated in FIG. 1 inside a frame thereof.

As illustrated in FIG. 1, an ink-jet printer 11 has a frame 12 that covers the inner components thereof. The ink-jet printer 11 is a fluid ejecting apparatus according to the present embodiment of the invention, though the fluid ejecting apparatus according to the invention is not limited to the printer. As illustrated in FIG. 2, the ink-jet printer 11 is provided with, inside the frame 12 thereof, a guide axis 14, a carriage 15, a recording head 20, valve units 21, and a pressure pump 25. The recording head 20 is a non-limiting example of a fluid or liquid ejecting head according to the invention. As illustrated in FIG. 1, ink cartridges 23 are detachably attached to the ink-jet printer 11. The ink cartridge 23 is a non-limiting example of a fluid or liquid container according to the invention.

As illustrated in FIG. 1, the frame 12 is configured as a box-like housing case that has the shape of a substantially rectangular parallelepiped. The frame 12 has a cartridge holder 12*a* at the front portion thereof.

The guide axis 14, which is formed as a shaft, is provided in the frame 12 as shown in FIG. 2. In the configuration of the ink-jet printer 11 according to the present embodiment of the invention, a direction in which the guide axis 14 extends is referred to as a main scan direction. The guide axis 14 penetrates through the carriage 15 in such a manner that the carriage 15 can reciprocate on the guide axis 14 in the main scan direction.

The carriage 15 is fixed to a timing belt, which is not illustrated in the drawing. The carriage 15 is indirectly connected to a carriage motor through the timing belt. The carriage motor is not illustrated in the drawing. The frame 12 supports the carriage motor. As the carriage motor is driven, a driving force is transmitted to the carriage 15 via the timing belt. By this means, the carriage 15 reciprocates along the guide shaft 14 in the main scan direction.

The recording head 20 is provided at the bottom surface of the carriage 15. The recording head 20 is provided with a plurality of nozzles, which is not shown in the drawing. The nozzles of the recording head 20 eject ink, which is a non-limiting example of a fluid or liquid according to the invention. The recording head 20 discharges ink drops from the nozzles thereof onto a recording target medium such as a sheet of recording paper. In this way, the ink-jet printer 11 records print data such as images, characters, though not limited thereto, onto the sheet of recording paper. The valve units 21 are mounted on the carriage 15. The valve units 21 supply ink that has been temporarily retained thereat to the recording head 20 under a controlled pressure.

In the configuration of the ink-jet printer 11 according to the present embodiment of the invention, each of the valve units 21 is capable of independently supplying two color types of ink to the recording head 20 under a controlled pressure. In addition, in the configuration of the ink-jet printer 11 according to the present embodiment of the invention, three valve units 21 are provided. Since each of these three valve units 21 is capable of supplying two color types of ink as described above, these valve units 21 correspond to six ink colors. In the configuration of the ink-jet printer 11 according to the present embodiment of the invention, six ink colors are made up of black, yellow, magenta, cyan, light magenta, and light cyan.

A platen is formed under the recording head 20. The platen supports a recording target medium, which is an object that is transported by a feeding mechanism along a sub scan direction orthogonal to the main scan direction. The platen is not shown in the drawing. In the configuration of the ink-jet printer 11 according to the present embodiment of the invention, the feeding mechanism is a paper feeder, which is not shown in the drawing.

Fluid Container

As shown in FIG. 1, the ink cartridges 23 are detachably attached to the cartridge holder 12*a*. The ink cartridge 23 is a non-limiting example of a fluid or liquid container according to the invention. Six ink cartridges 23 are provided so as to correspond to the above-mentioned six ink colors. In the following description, the configuration of the ink cartridge 23 is explained while referring to FIGS. 3, 4, and 5.

Figure 3:
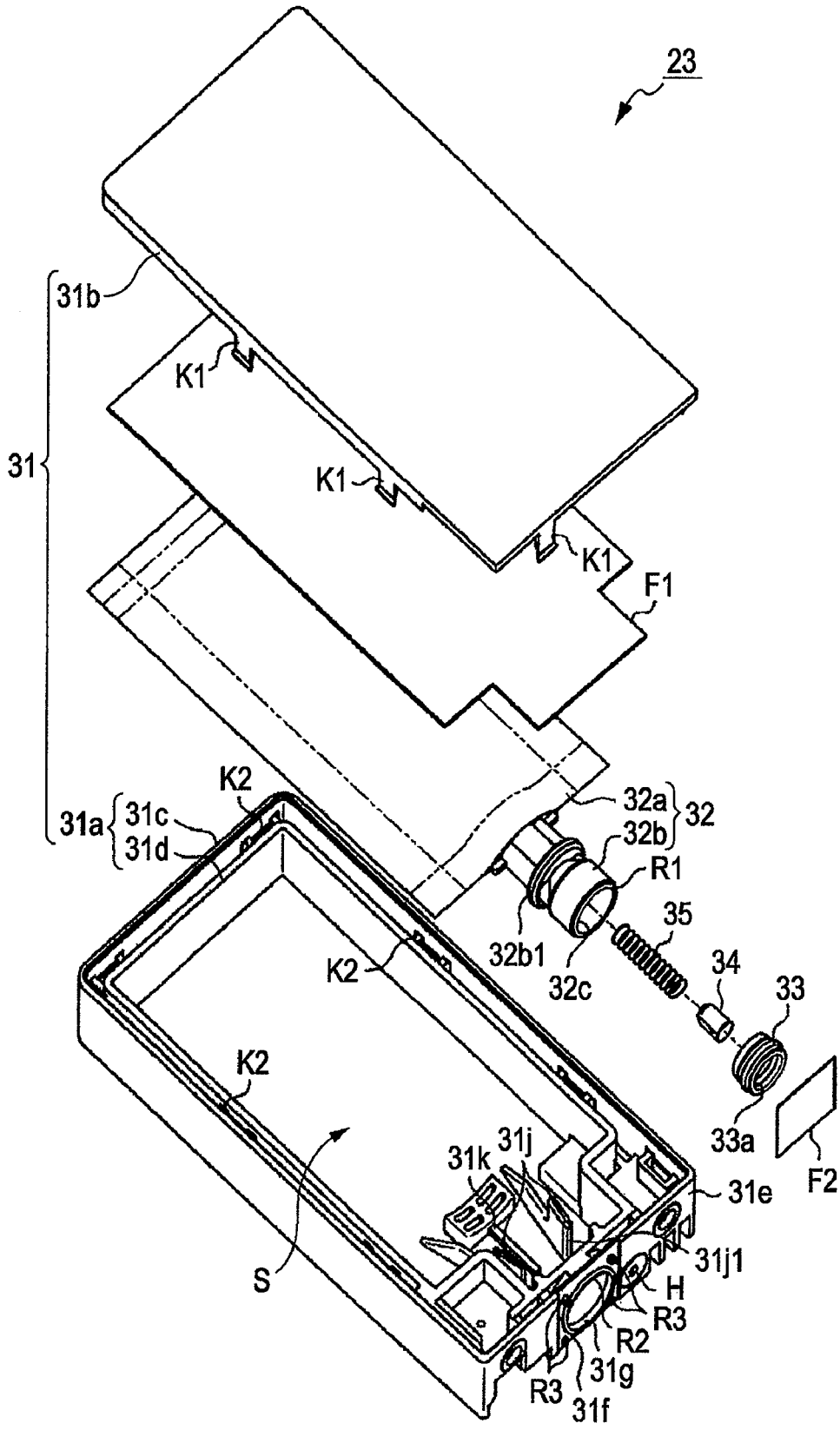
FIG. 3 is an exploded perspective view that schematically illustrates an example of the configuration of one of ink cartridges illustrated in FIG. 1.

As illustrated in FIG. 3, the ink cartridge 23 is mainly made up of a main body case 31*a*, an upper case 31*b*, and an ink pack 32. The ink pack 32 is a bag that contains ink. A combination of the main body case 31*a* and the upper case 31*b* constitutes an ink case 31. The ink pack 32 is encased in the ink case 31. FIG. 3 shows only one of six cartridges 23. Since each of the remaining five ink cartridges 23 has the same configuration as that of the illustrated one ink cartridge 23, illustrations thereof are omitted.

As shown in FIG. 3, the ink pack 32 has an ink bag 32*a*, an ink outlet member 32*b*, and a sealing member 33. The ink bag 32*a* constitutes a flexible ink-containing portion in the configuration of the ink cartridge 23 described herein. The ink outlet member 32*b* is a non-limiting example of a fluid or liquid outlet section according to the invention. The ink bag 32*a* is made of a material having flexibility and "gas-barrier" property. The ink bag 32*a* is made of, though not limited thereto, two sheets of aluminum-laminated sealing film. Each sheet has outer and inner sealing films sandwiching the aluminum film therebetween. The outer sealing film is a nylon sealing film, and the inner sealing film is a polypropylene sealing film, a polyethylene sealing film, for example. Any other equivalent sealing films may be used as the outer and inner sealing film. The peripheral regions of these two sheets of aluminum-laminated sealing film are adhered to each other by means of a thermal adhesion method or any other alternative method so as to make up the ink bag 32*a*.

The ink outlet member 32*b* is made of, for example, polypropylene. The ink outlet member 32*b* is fixed to the ink bag 32*a* by means of a thermal adhesion method, though not limited thereto. Specifically, the adhering of the ink outlet member 32*b* to the ink bag 32*a* is performed as follows. In the production process of the ink bag 32*a*, three sides of two sheets of aluminum-laminated sealing film that are arrayed to overlap each other are adhered to each other by thermal adhesion, while one side thereof remains open (i.e., is not adhered). Thereafter, the ink outlet member 32*b* is placed at the middle of the remaining one side thereof, followed by the application of heat to the above-mentioned one open side. In this way, the ink outlet member 32*b* is thermally adhered to the ink bag 32*a*. Ink contained in the ink bag 32*a* is in a degasified state. The ink outlet member 32*b* has a substantially cylindrical shape. An ink outlet port 32*c* is formed as the inside region of the ink outlet member 32*b*. The ink outlet port 32*c* comprises a part of a fluid flow channel according to the invention. Ink contained in the ink bag 32*a* is taken out thereof through the ink outlet port 32*c*.

Figure 4:
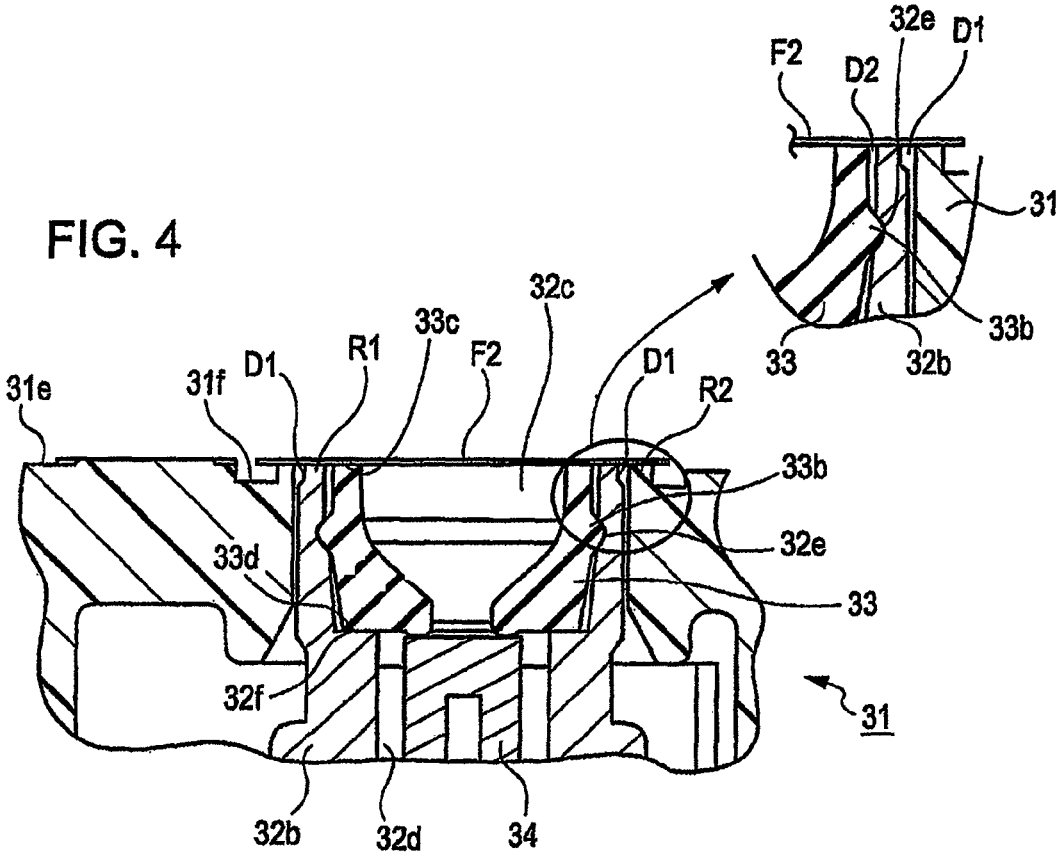
FIG. 4 is a sectional view that schematically illustrates an example of the partial configuration of an ink cartridge, and a sealing structure thereof, according to an exemplary embodiment of the invention.

A valve mechanism that is opened only when ink is supplied is provided on the ink outlet port 32*c*. Such a valve structure prevents any ink contained in the ink bag 32*a* from leaking through the ink outlet port 32*c*. The valve mechanism of the ink outlet port 32*c* has a movable valve member 34 and a coil spring 35. Specifically, the valve member 34 is provided in the ink outlet port 32*c* of the ink outlet port member 32*b* at a deeper position that is relatively remote from the opening of the ink outlet port 32*c* in comparison with the position of the sealing member 33. The valve member 34 is placed so as to be able to contact with the sealing member 33. The coil spring 35 applies a pressing force to the valve member 34 to press the valve member 34 against the sealing member 33. The coil spring 35 is a non-limiting example of an urging member according to the invention. As explained above, the coil spring 35 urges the valve member 34 toward the sealing member 33. Since the coil spring 35 urges the valve member 34 toward the sealing member 33, as illustrated in FIG. 4, the valve member 34 blocks the supply port 33*a* of the sealing member 33. In addition thereto, a sealing film F2 covers the supply port 33*a* of the sealing member 33. A more detailed explanation of the sealing film F2 will be given later.

Figure 5:
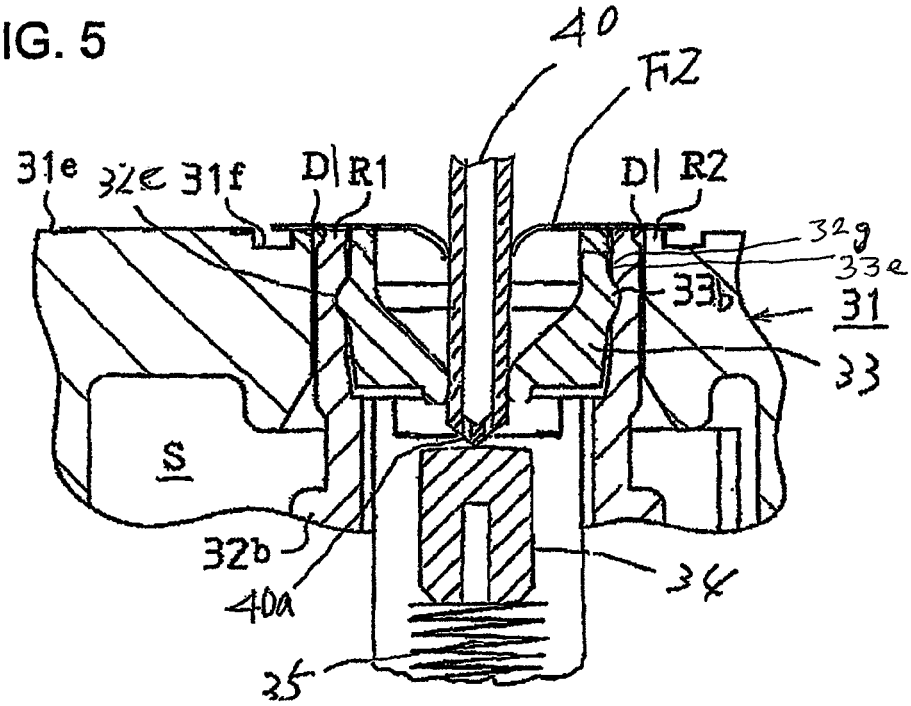
FIG. 5 is a sectional view that schematically illustrates an example of the partial configuration of the ink cartridge, and the sealing structure thereof, into which an ink take-out needle is inserted.

When the ink cartridge 23 is attached to the cartridge holder 12*a*, an ink supply needle 40 of the ink-jet printer 11 pierces through the sealing film F2 and inserted into the ink outlet member 32*b*. The ink supply needle 40 is a non-limiting example of a fluid take-out needle formed on a fluid ejecting apparatus according to the invention. As the ink supply needle 40 of the ink-jet printer 11 pierces through the sealing film F2 to enter the ink outlet member 32*b*, the ink supply needle 40 presses the valve member 34 toward the ink bag 32*a* against the urging force applied from the coil spring 35 thereto as illustrated in FIG. 5. As the valve member 34 comes away from the sealing member 33, a clearance is formed between the sealing member 33 and the valve member 34. As a result thereof, ink contained in the ink bag 32*a* flows through the clearance to enter a plurality of minute holes 40*a* formed at the tip of the ink supply needle 40. Then, through these minute holes 40*a* of the ink supply needle 40, the ink flows out of the ink outlet port 32*c* of the ink outlet member 32*b*.

That is, when the ink supply needle 40 is not inserted into the ink outlet member 32*b*, the sealing member 33 functions as a valve seat member that blocks the ink outlet port 32*c*. When the ink supply needle 40 is inserted into the ink outlet member 32*b*, the ink supply needle 40 presses the valve member 34 away from the sealing member 35, the valve member 34 comes away from the sealing member 33 against the urging force applied from the coil spring 35, then the ink outlet port 32*c* is opened.

As illustrated in FIG. 3, the main body case 31*a* is made up of an outer case 31*c* and an inner case 31*d*. Each of the outer case 31*c* and the inner case 31*d* is made of, for example, polypropylene or polyethylene, though not limited thereto. The outer case 31*c* is configured as an open-topped box that has the shape of a substantially rectangular parallelepiped. The inner case 31*d* is a size smaller (i.e., slightly smaller) than the outer case 31*c*. The shape of the inner case 31*d* resembles that of the ink pack 32. The inner case 31*d* provides a support to the ink pack 32 so that the ink pack 32 does not move in accordance with the movement of the ink case 31. The upper case 31*b* is configured as a plate member that has a substantially rectangular shape. The upper case 31*b* functions as a lid plate that covers the top of the main body case 31*a*. The upper case 31*b* is made of, for example, polypropylene, though not limited thereto. The upper case 31*b* has latch-projection members K1 that are formed at several predetermined positions thereon. When the upper case 31*b* is placed on the main body case 31*a* so as to cover the top thereof, each of these latch-projection members K1 becomes engaged with the corresponding one of latch-recess members K2 that are formed at a gap region between the outer case 31*c* and the inner case 31*d*.

A supply port attachment portion 31*f* is formed at the middle of the front surface 31*e* of the main body case 31*a*. The supply port attachment portion 31*f* has a square shape. The supply port attachment portion 31*f* has an opening 31*g* that is communicated with the inner case 31*d*. The opening 31*g* of the supply port attachment portion 31*f* has a circular rim at the edge thereof. A ring-shaped projecting portion R2 is formed on the circular rim. The ring-shaped projecting portion R2 protrudes away from the ink case 31. Four columnar projecting portions R3 are formed at each of four corners of the supply port attachment portion 31*f*, respectively. Each of the columnar projecting portions R3 protrudes away from the ink case 31. The amount (i.e., height or length) of protrusion of each of the columnar projecting portions R3 is the same as that of the ring-shaped projecting portion R2.

A pressure-application hole H is formed next to the supply port attachment portion 31*f*. The outside of the main body case 31*a* is communicated with the inner case 31*d* via the pressure-application hole H.

The ink pack 32 is placed into the inner case 31*d* of the ink case 31 in such a manner that the ink outlet member 32*b* of the ink pack 32 is exposed to the outside via the opening 31*g* of the supply port attachment portion 31*f*. As illustrated in FIG. 5, when the ink pack 32 is placed into the ink case 31 as explained above, the position thereof is adjusted so that the front-end region R1 of the ink outlet member 32*b*, which is exposed through the opening 31*g* of the supply port attachment portion 31*f*, is protruded at the same level as, that is, is substantially on the same plane as, the ring-shaped projecting portion R2.

After placing the ink pack 32 into the inner case 31*d*, a sealing film F1 is adhered to the top of the inner case 31*d* by thermal adhesion or the like as understood from FIG. 3. The sealing film F1 is made of, for example, polypropylene or polyethylene, though not limited thereto.

Sealing Structure

The sealing member 33, which is provided in the ink outlet port 32*c* of the ink outlet member 32*b*, is made of an elastic material such as a thermoplastic elastomer (TPE). The sealing member 33 is configured as an elastic ring that has a substantially cylindrical shape. The top surface of the cylindrical sealing member 33 and the bottom surface thereof are open. As illustrated in FIGS. 4 and 5, the inner region of the sealing member 33 constitutes the aforementioned supply port 33*a* that is formed in the shape of a funnel. Having such a configuration, the sealing member 33 elastically seals the circumference of the ink supply needle 40. As the ink supply needle 40 is inserted into the supply port 33*a* of the sealing member 33, the ink take-in holes (minute holes 40*a*) thereof are positioned in the flow channel 32*d* of the ink outlet member 32*b*. By this means, ink contained in the ink bag 32*a* is supplied to the ink-jet printer 11.

A concave portion 32*e* is formed in the side surface 32*g* of the inner wall of the ink outlet member 32*b*, which constitutes the ink outlet port 32*c* thereof. A convex portion 33*b* that fits in the concave portion 32*e* is formed on the outer circumferential surface 33*e* of the sealing member 33. In the configuration of the present embodiment, the outer surfaces 33*e* and 33*d* of the sealing member 33 contact the inner-wall surfaces 32*g* and 32*f* of the ink outlet port 32*c* of the ink outlet member 32*b*, respectively. Accordingly, the position of the sealing member 33 is determined to the ink outlet member 32*b*. In other words, in regard to the insertion direction of the ink supply needle 40, the position of the sealing member 33 is determined by bringing the surface 33*d* of the sealing member 33 that is opposite the surface 33*c* covered by the sealing film F2, into contacts with the bottom surface 32*f* of the inner-wall of the ink outlet port 32*c* of the ink outlet member 32*b*. On the other hand, in regard to the direction orthogonal to the insertion direction of the ink supply needle 40, the position of the sealing member 33 is determined by bringing the convex portion 33*b* formed on the outer circumferential surface 33*e* of the sealing member 33 into contact with the concave portion 32*e* formed in the side surface 32*g* of the inner wall of the ink outlet member 32*b*.

In the configuration of the present embodiment, the sealing film F2 is thermally adhered to the supply port attachment portion 31*f*. As understood from FIG. 3, specifically, the sealing film F2 is thermally adhered to the ring-shaped projecting portion R2 that is formed on the circular rim of the opening 31*g* of the supply port attachment portion 31*f* and protrudes from the supply port attachment portion 31*f* in an outward direction. The sealing film F2 is also thermally adhered to the front-end region R1 of the ink outlet member 32*b*. The sealing film F2 is further thermally adhered to the open-end surface 33*c* of the sealing member 33. In addition, the sealing film F2 is further thermally adhered to each of the columnar projecting portions R3.

In the related art, the sealing member is made of butyl rubber. On the other hand, the ink case and the ink outlet member is not made of butyl-rubber. Since there is no commonality therebetween, regardless of what kind of a material is adopted for a sealing film, it is practically impossible, or at best difficult, to adhere the sealing member, together with the ink case and the ink outlet member, to the sealing film.

In contrast, the inventors have succeeded in adhering the sealing member 33, together with the ink case 31 and the ink outlet member 32, to the sealing film F2 as a result of the following selection of the material of the sealing member 33. One example of a thermoplastic elastomer that can be suitably adopted as the material of the sealing member 33 is MNCS (product name) that is commercially available from Bridgestone Corporation. A reference for this product is found in JP-A-2002-225303. As the results of experiment, the inventors found that the sealing member 33 made of the above-identified material can be adhered, with an excellent thermal adhesion property, to a polyolefin such as polypropylene (PP), polyethylene (PE), erythropoietin (EPO), though not limited thereto.

Since the ink outlet member 32*b* is thermally adhered to the ink bag 32*a* in the configuration of the ink cartridge 23 as described above, it is preferable that the material of the ink outlet member 32*b* should be the same as that of the ink bag 32*a*. That is, it follows that the same single material, for example, polypropylene or polyethylene, is used for each of the ink bag 32*a*, the ink outlet member 32*b*, and the ink case 31 in the configuration of the present embodiment. If polypropylene or polyethylene is also used as the material of the sealing film F2, it is possible to achieve the above-described thermal adhesion.

With such a configuration, as a result of the thermal adhesion of the sealing film F2 to the ring-shaped projecting portion R2, the front-end region R1 of the ink outlet member 32*b*, and the sealing member 33, the sealing film F2 seals a clearance D1 between the opening 31*g* and the ink outlet member 32*b* and a clearance D2 between the ink outlet member 32*b* and the sealing member 33.

Since the sealing film F2 seals the clearance D2 as explained above, the concave portion 32*e*, which is formed in the side surface 32*g* of the inner wall of the ink outlet port 32*c* of the ink outlet member 32*b*, and the convex portion 33*b*, which is formed on the outer circumferential surface 33*e* of the sealing member 33, function in combination with each other only to determine the position of the sealing member 33. That is, the concave portion 32*e* and the convex portion 33*b* do not necessarily have to provide a fluid-tight sealing therebetween. On the basis of the fact described above, it is understood that the convex portion 33*b* of the sealing member 33 and the concave portion 32*e* of the ink outlet member 32*b* are not indispensable constituent elements of the invention. That is, as a modification example of the present embodiment, either one or both of the side surface 32*g* of the inner wall of the ink outlet member 32*b*, which constitutes the ink outlet port 32*c* thereof, and the outer circumferential surface 33*e* of the sealing member 33 may be configured as a flat surface(s).

The sealing of the clearance D2 by means of the sealing film F2 offers the following unique advantageous effects of the invention. For example, if the precision in the actual circularity of the ink outlet port 32*c* of the ink outlet member 32*b* is poor, or in other words, if the margin of errors in the actual roundness of the ink outlet port 32*c* of the ink outlet member 32*b* is large, the sealing property between the convex portion 33*b* of the sealing member 33 and the concave portion 32*e* of the ink outlet member 32*b* is also poor. In spite of such a possibly poor sealing property between the convex portion 33*b* of the sealing member 33 and the concave portion 32*e* of the ink outlet member 32*b*, the present embodiment makes it possible to prevent any ink from leaking through the clearance D2 because it is sealed by the sealing film F2. In addition, even in a case where pressure-supplied ink that is pumped out of the ink bag 32*a* in a forcible manner breaks the elastic sealing between the convex portion 33*b* of the sealing member 33 and the concave portion 32*e* of the ink outlet member 32*b*, the present embodiment makes it possible to prevent any ink from leaking through the clearance D2 because it is protectively sealed by the sealing film F2. Moreover, even in a case where the elastic sealing between the convex portion 33*b* of the sealing member 33 and the concave portion 32*e* of the ink outlet member 32*b* is broken temporarily when the ink cartridge 23 is inadvertently dropped or when any unexpected vibration is applied to the ink cartridge 23 from the outside, the present embodiment makes it possible to prevent any ink from leaking through the clearance D2 because it is protectively sealed by the sealing film F2.

On the other hand, the sealing of the clearance D1 in addition to the clearance D2 by means of the sealing film F2 offers the following unique advantageous effects of the invention.

As illustrated in FIG. 3, a space S that is demarcated by the inner case 31*d* and the sealing film F1 constitutes a fluid-tight compartment except that it is communicated with the outside only through the aforementioned pressure-application hole H. The ink pack 32 is encased into such a fluid-tight space S. The aforementioned pressure pump 25 shown in FIG. 1, which is supported by the frame 12, sends air into the inner case 31*d* through the pressure-application hole H. Since the inner case 31*d* is configured as a fluid-tight structure as explained above, air pressure is efficiently applied to the ink pack 32 that is placed in the space S.

In addition, the ink outlet port 32*c* of the ink outlet member 32*b* is sealed in a fluid-tight manner because the sealing film F2 is thermally adhered to the front-end region R1 of the ink outlet member 32*b*. With such a configuration, the inside of the ink pack 32 is hermetically sealed from the outside thereof. The sealing film F2 is thermally adhered to the ring-shaped projecting portion R2 so as to seal the ink outlet port 32*c* of the ink outlet member 32*b*. Therefore, the present embodiment makes it possible to avoid any air bubble from coming into the ink pack 32 when the valve member 34 is released as a result of the insertion of the ink supply needle 40 from the outside of the ink cartridge 23. Moreover, the sealing film F2 is thermally adhered to the columnar projecting portions R3 each of which is provided at a corner of the supply port attachment portion 31*f* with the ring-shaped projecting portion R2 being formed at the middle region thereof. Thanks to the presence of these columnar projecting portions R3, it is possible to effectively prevent the sealing film F2 from getting peeled away from the ring-shaped projecting portion R2 due to some external force.

The main body case 31*a* has a pair of ink-flow-out-port-member support ribs 31*j*, which is configured to clamp the ink outlet member 32*b*. The ink outlet member 32*b* is securely attached to the main body case 31*a* in such a manner that the end 31*j*1 of each of the ink-flow-out-port-member support ribs 31*j* is in contact with the circular projecting portion 32*b*1 of the ink outlet member 32*b*. The circular projecting portion 32*b*1 is formed in the shape of a disc on the outer circumference of the ink outlet member 32*b*. Since the end 31*j*1 of each of the ink-flow-out-port-member support ribs 31*j* holds the disc-shaped projecting portion 32*b*1 of the ink outlet member 32*b*, it is possible to prevent the ink outlet member 32*b* from moving inside the main body case 31*a* during a thermal adhesion process.

Anti-rotation member 31*k* is provided in the main body case 31*a*. The anti-rotation member 31*k* is a projection that engages with a corresponding recess formed in the disc-shaped projecting portion 32*b*1 of the ink outlet member 32*b*. This recess is omitted from the drawing. The anti-rotation member 31*k* prevents the movement of the ink pack 32 in a rotational direction thereof. With such a structure, the anti-rotation member 31*k* securely holds the ink pack 32 at a predetermined position.

Operation of Fluid Ejecting Apparatus

Next, an explanation is given below as to how the ink-jet printer 11 having the configuration described above operates at the time when it supplies ink and performs printing.

As illustrated in FIG. 1, a user can attach the ink cartridge 23 of each ink color to the cartridge holder 12*a* by sliding the ink cartridge 23 on the cartridge holder 12*a* toward a distal end, which is viewed along the scanning direction. As the ink cartridge 23 is set onto the cartridge holder 12*a*, the ink supply needle 40 that is provided on the cartridge holder 12*a* pierces through the sealing film F2 so as to be joined with, or in other words, enter, the ink outlet member 32*b*. The ink supply needle 40 is communicated with the valve units 21 through ink supply tubes 36. With such a configuration, ink contained in the ink pack 32 is supplied to the valve units 21. Then, the valve units 21 supply ink that has been temporarily retained thereat to the recording head 20 under a controlled pressure.

On the other hand, an air take-in member that is provided on the cartridge holder 12*a* is connected to the pressure-application hole H of the main body case 31*a* of the ink cartridge 23. The air take-in member is connected to the pressure pump 25 via an air take-in tube. With such a configuration, the pressure pump 25 is capable of supplying compressed air for pressurizing the aforementioned space S in which the ink pack 32 is placed. As has already been explained above, the sealing film F1 seals the top of the inner case 31*d*, whereas the sealing film F2 seals the clearances D1 and D2 shown in FIG. 4. With such a hermetically sealed structure, air that is fed into the inner case 31*d* through the pressure-application hole H does not escape to the outside of the ink cartridge 23. In addition, there is no substantial risk of the leakage of ink through the clearance D2. Therefore, it is possible to control pressure applied to the ink pack 32 with a high precision.

When air pressure is applied to the ink pack 32 of each of the ink cartridges 23 by the pressure pump 25 as explained above, ink contained in the ink pack 32 is supplied to the corresponding valve unit 21. Then, the valve units 21 supply ink that has been temporarily retained thereat to the recording head 20 under a controlled pressure.

While transporting the recording target medium P such as a sheet of printing paper by means of a paper-feeding section in the sub scan direction, the ink-jet printer 11 according to the present embodiment of the invention reciprocates the carriage 15 in the main scan direction. While the carriage 15 travels along the main scan direction, the recording head 20 thereof ejects ink drops onto the recording target medium P. In this way, the ink-jet printer 11 according to the present embodiment of the invention performs printing on a sheet of printing paper.

The foregoing exemplary embodiment of the invention may be modified as follows.

It is explained in the foregoing exemplary embodiment of the invention that the ink supply needle 40 that is provided on the cartridge holder 12*a* pierces through the sealing film F2 so as to enter the ink outlet member 32*b*. For the purpose of making it easier for the ink supply needle 40 to pierce through the sealing film F2, an incision or a hole may be pre-formed in the sealing film F2. The shape of the incision may be, for example, a cross or an alphabet X, though not limited thereto.

It is explained in the foregoing exemplary embodiment of the invention that one ring-shaped projecting portion R2 only is provided on the front surface 31*e* of the ink case 31. However, the configuration of the ink cartridge 23 according to the embodiment of the invention is not limited to such a configuration. For example, two or more ring-shaped projecting portions R2 may be provided. If so modified, it is possible to increase the strength of thermal adhesion of the sealing film F2.

It is explained in the foregoing exemplary embodiment of the invention that the material of each of the ink case 31, the sealing member 33, and the sealing film F2 is polypropylene. However, it is possible to replace the above-described material with any substitute material as long as it has a thermal adhesion property. A non-limiting example of such a substitute material is polyethylene.

It is explained in the foregoing exemplary embodiment of the invention that the sealing film F2 has a square shape and a size that is the same as the size of the supply port attachment portion 31*f*. Notwithstanding the foregoing, the shape and/or size of the sealing film F2 may be modified as long as it can at least cover the clearances D1 and D2. As a non-limiting example of modification thereof, the sealing film F2 may have a circular shape having a diameter equal to one side of the supply port attachment portion 31*f*; it may be ring-shaped one that covers the clearances D1 and D2.

It is explained in the foregoing exemplary embodiment of the invention that the number of the ink cartridges 23 that are attached to the ink-jet printer 11 is six. However, the invention should be in no case understood to be limited to such a specific configuration. The number thereof may be modified.

Second Embodiment

Figure 6:
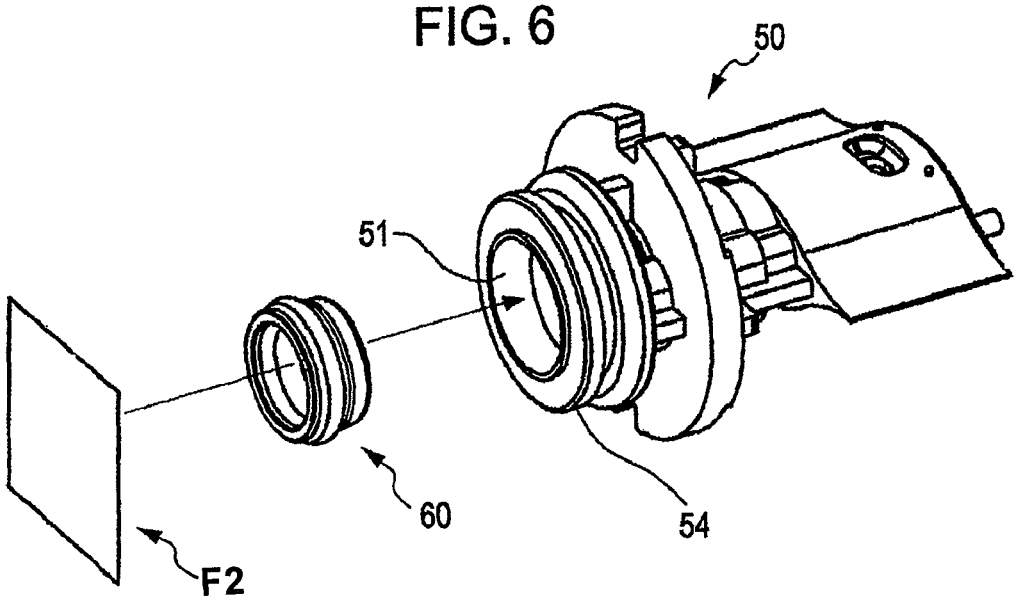
FIG. 6 is an exploded perspective view that schematically illustrates an example of the configuration of a sealing structure according to a second embodiment of the invention.

FIG. 6 is an exploded perspective view that schematically illustrates an example of the configuration of an ink outlet member 50, which has the following points of differences from the above-described configuration of the ink outlet member 32*b* according to the first embodiment of the invention. Firstly, the ink outlet member 50 illustrated in FIG. 6 has an external shape different from that of the ink outlet member 32*b* according to the first embodiment of the invention described above. Secondly, in the configuration of the ink outlet member 50 according to the present embodiment of the invention, the sealing film F2 is not thermally adhered to the ink case 31 at all but thermally adhered to the ink outlet member 50 and a sealing member 60 only. The ink outlet member 50 according to the present embodiment of the invention differs from the ink outlet member 32*b* according to the first embodiment of the invention described above in these points only. Except for the above-identified differences, the ink outlet member 50 according to the present embodiment of the invention has the same configuration as that of the ink outlet member 32*b* according to the first embodiment of the invention described above.

Figure 7:
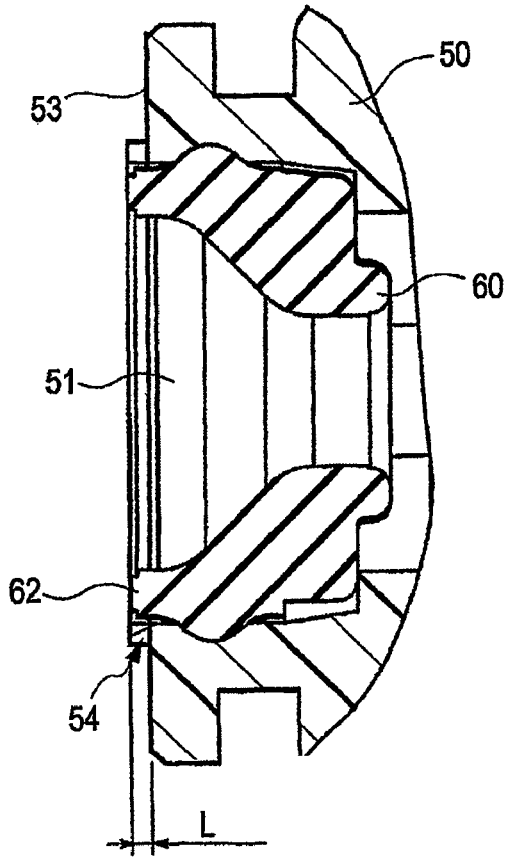
FIG. 7 is a sectional view that schematically illustrates an example of the partial configuration of the sealing structure illustrated in FIG. 6 and that specifically illustrates an assembly state prior to the thermal adhesion of a sealing film thereto.

FIG. 7 is a sectional view that schematically illustrates an example of the partial configuration of a sealing structure according to the present embodiment of the invention. Specifically, FIG. 7 shows the ink outlet member 50 and the sealing member 60, the latter of which is inserted in the ink outlet port 51 of the former thereof. It should be noted that FIG. 7 illustrates an assembly state prior to the thermal adhesion of the sealing film F2 to these members 50 and 60.

The ink outlet member 50 has a first adhesion allowance portion 54. The first adhesion allowance portion 54 has a ring shape. The first adhesion allowance portion 54 protrudes outward by a height L from an open-end surface 53 of the ink outlet member 50 as illustrated in the drawing. Likewise the ink outlet member 50, the sealing member 60 has a second adhesion allowance portion 62. The second adhesion allowance portion 62 has a ring shape. As illustrated in the drawing, the second adhesion allowance portion 62 protrudes outward by the height L, which is measured from the open-end surface 53 of the ink outlet member 50 in a state in which the sealing member 60 is fitted in the ink outlet port 51 of the ink outlet member 50. As understood from the explanation given above, the first adhesion allowance portion 52 and the second adhesion allowance portion 62 are the same level with each other, that is, on the same plane.

After the fitting of the sealing member 60 into the ink outlet member 50 to make up an assembly structure illustrated in FIG. 7, the sealing film F2 is placed on the first adhesion allowance portion 54 and the second adhesion allowance portion 62. Thereafter, heat and pressure are applied thereto so as to adhere the sealing film F2 to the sealing member 60 and the ink outlet member 50. As a result of application of heat and pressure thereto, both of the first adhesion allowance portion 54 and the second adhesion allowance portion 62 melt away and fuse, together with the melted part of the sealing film F2, into a single adhered structure. By this means, the sealing film F2 is adhered to become flush with the open-end surface 53 of the ink outlet member 50 because, after adhesion, the first adhesion allowance portion 54 and the second adhesion allowance portion 62 have melted away.

Since the first adhesion allowance portion 54 and the second adhesion allowance portion 62 have been formed in advance each in the form of a protruding ring as explained above, it is possible to determine, without fault, melting regions of a sealing structure. This makes it further possible to complete thermal adhesion work with comparatively small pressure in a comparatively short time period. In addition, as the application of heat and pressure thereto is continued until the first adhesion allowance portion 54 and the second adhesion allowance portion 62 have completely melted away, it is possible to visually check whether the ongoing thermal adhesion work should be ended or not depending on the melting state of the first adhesion allowance portion 54 and the second adhesion allowance portion 62. This results in considerable reduction in the occurrences of defective adhesion.

The present embodiment provides reliable sealing at a region corresponding to the clearance D2 shown in FIG. 4, thereby preventing the leakage of ink through the region corresponding to the clearance D2. In this respect, the present embodiment offers the same advantage as that of the sealing structure according to the first embodiment of the invention described above. Therefore, except that the present embodiment does not offer advantageous effects that are produced as a result of sealing the clearance D1, it offers the same advantage as that of the first embodiment described above. Moreover, modification examples given in the description of the first embodiment of the invention are also applicable to the present embodiment of the invention except that it is not necessary to block or cover the clearance D1, which is, unlike the foregoing first embodiment of the invention. The first adhesion allowance portion 54 and the second adhesion allowance portion 62 illustrated in FIG. 7 may be applied to the first embodiment of the invention.

Third Embodiment

With reference to FIGS. 8, 9A, 9B, 10, 11, 12, 13, 14A, and 14B, a third exemplary embodiment of the invention is explained below. The difference between the third embodiment of the invention and the first embodiment of the invention lies in the configuration of an ink cartridge that constitutes a non-limiting example of a fluid container according to the invention. An ink cartridge according to the present embodiment of the invention can be attached to a fluid ejecting apparatus that is the same as, or similar to, that of the first embodiment of the invention described above. Accordingly, a detailed explanation of a fluid ejecting apparatus is not given herein so as to omit any redundant description.

Figure 8:
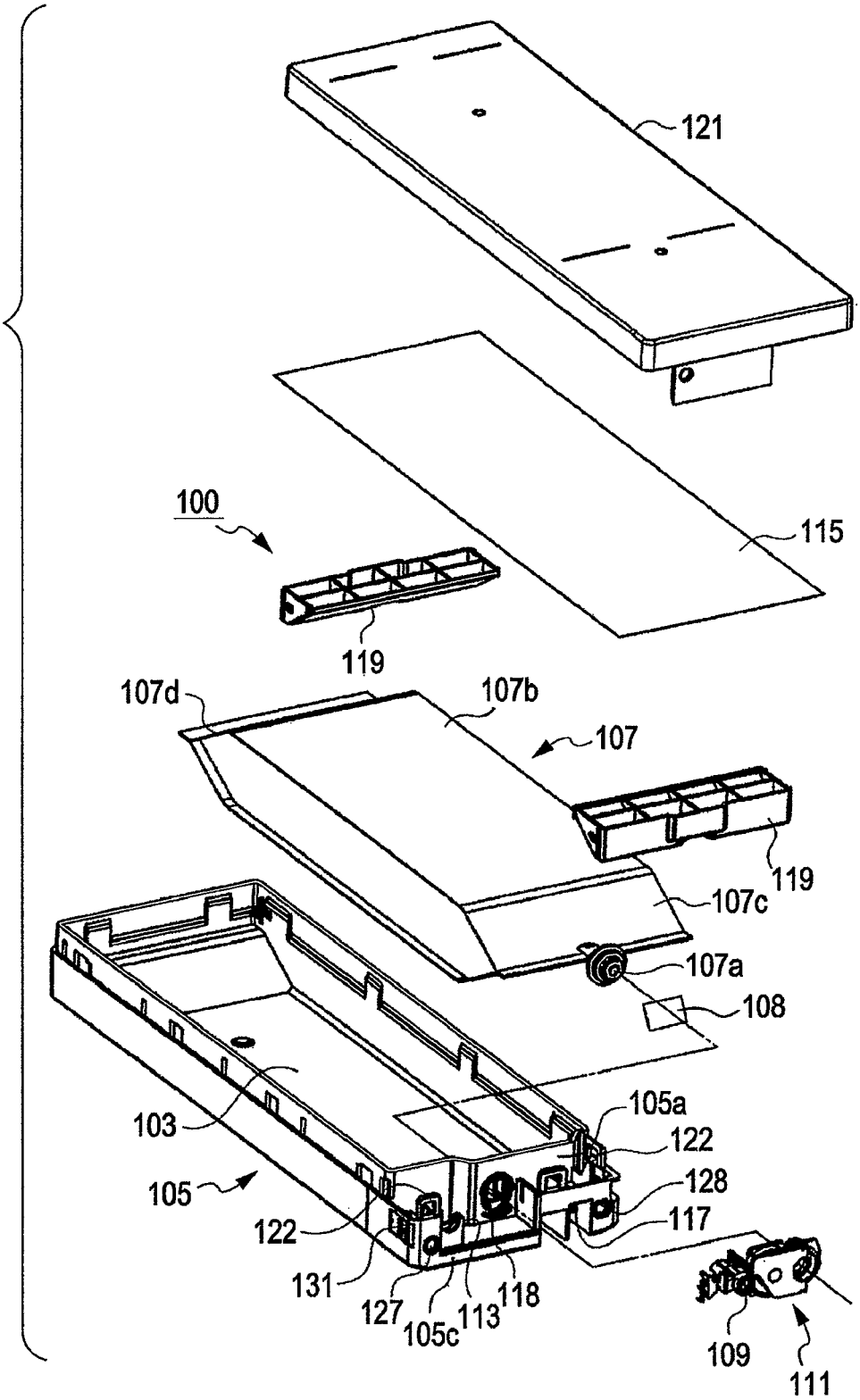
FIG. 8 is an exploded perspective view that schematically illustrates an example of the configuration of an ink cartridge according to a third embodiment of the invention.
Figure 9A:
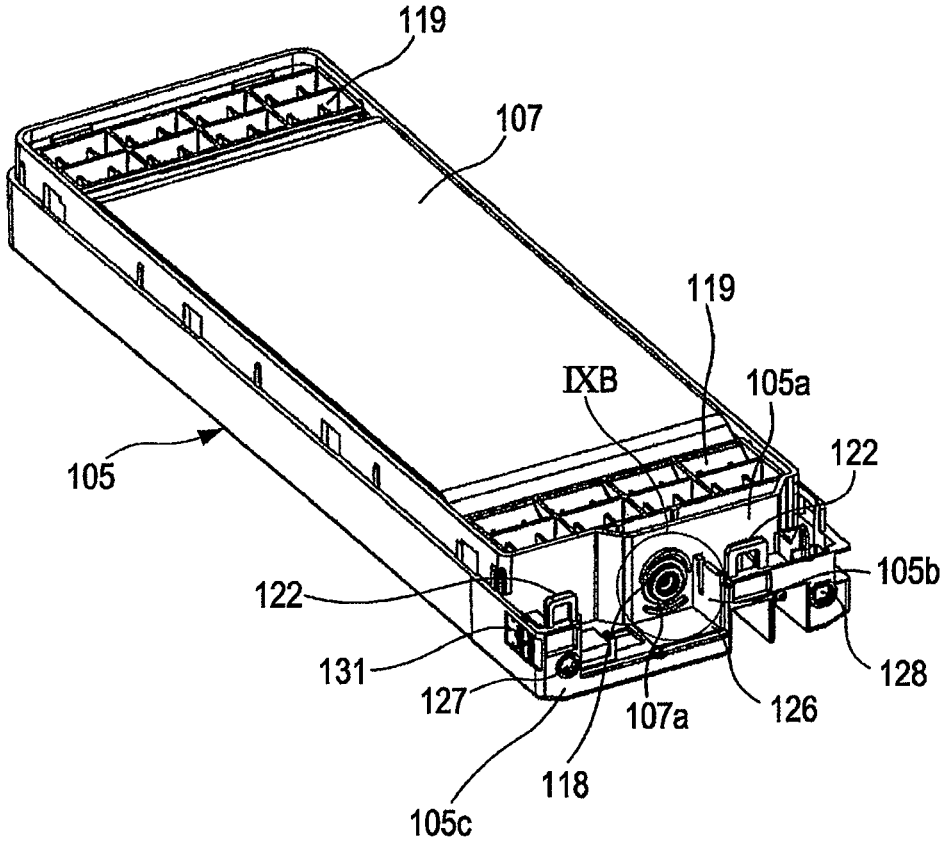
FIG. 9A is a perspective view that schematically illustrates an example of the configuration of the ink cartridge illustrated in FIG. 8, specifically, an encasement state thereof in which an ink pack is encased in the bag-housing portion of the main body of the ink cartridge.
Figure 9B:
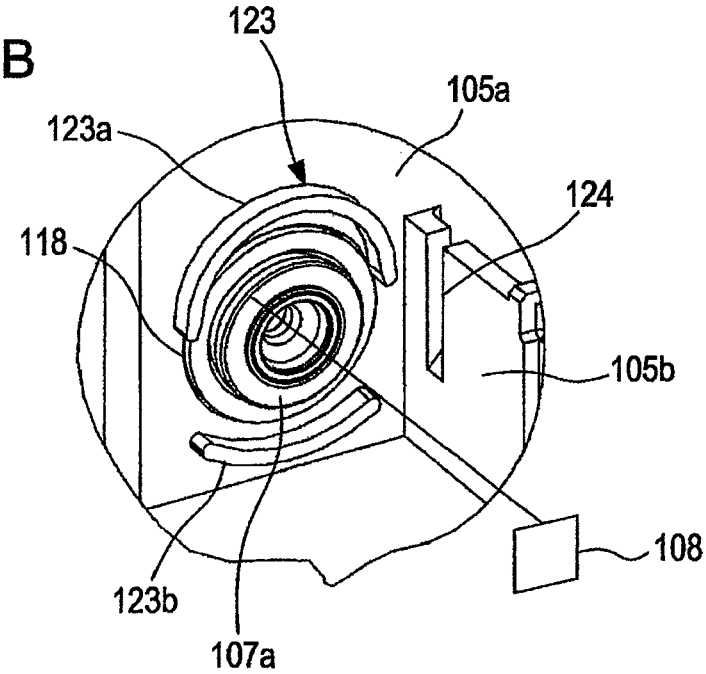
FIG. 9B is an enlarged view of the section A illustrated in FIG. 9A.
Figure 10:
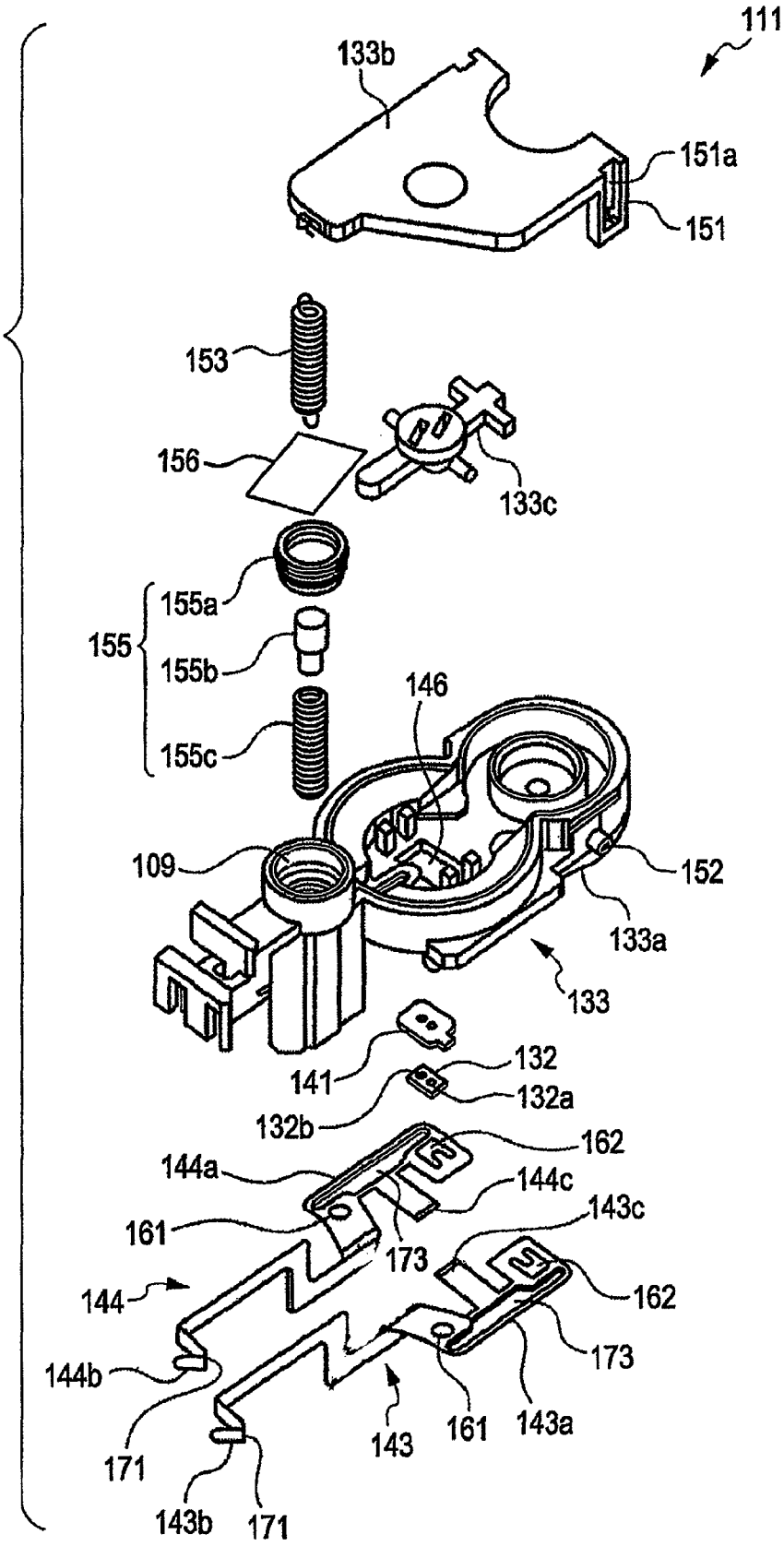
FIG. 10 is an exploded perspective view that schematically illustrates an example of the configuration of a liquid remaining amount detection unit that is shown in FIG. 8.

FIG. 8 is an exploded perspective view that schematically illustrates an example of the configuration of an ink cartridge that is a non-limiting example of a fluid container according to the third embodiment of the invention. FIG. 9A is a perspective view that schematically illustrates an example of the configuration of the ink cartridge illustrated in FIG. 8, specifically, an encasement state thereof in which an ink pack, which is a non-limiting example of a liquid or fluid containing portion, and spacer members, each of which fills a peripheral gap next to the ink pack, are encased in the bag-housing portion of the main body of the ink cartridge. FIG. 9B is an enlarged view of the section A illustrated in FIG. 9A. FIG. 10 is an exploded perspective view that schematically illustrates an example of the configuration of a liquid remaining amount detection unit that is shown in FIG. 8.

Figure 11:
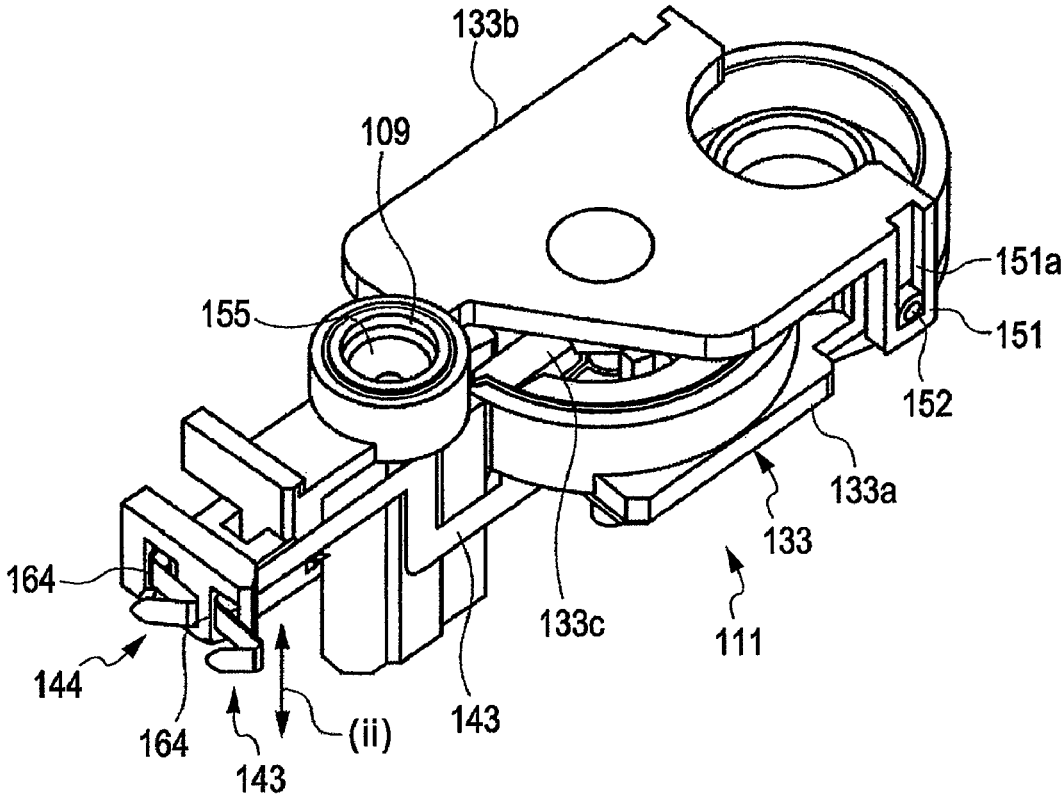
FIG. 11 is an assembly perspective view that schematically illustrates an example of the configuration of the liquid remaining amount detection unit.
Figure 12:
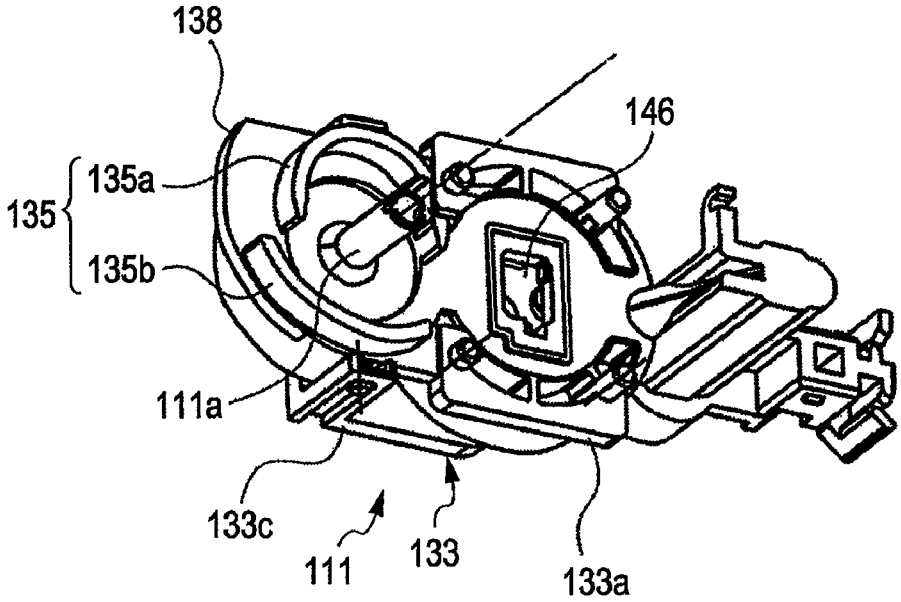
FIG. 12 is a rear perspective view that schematically illustrates an example of the configuration of the liquid remaining amount detection unit, which is viewed from the reverse side thereof.
Figure 13:
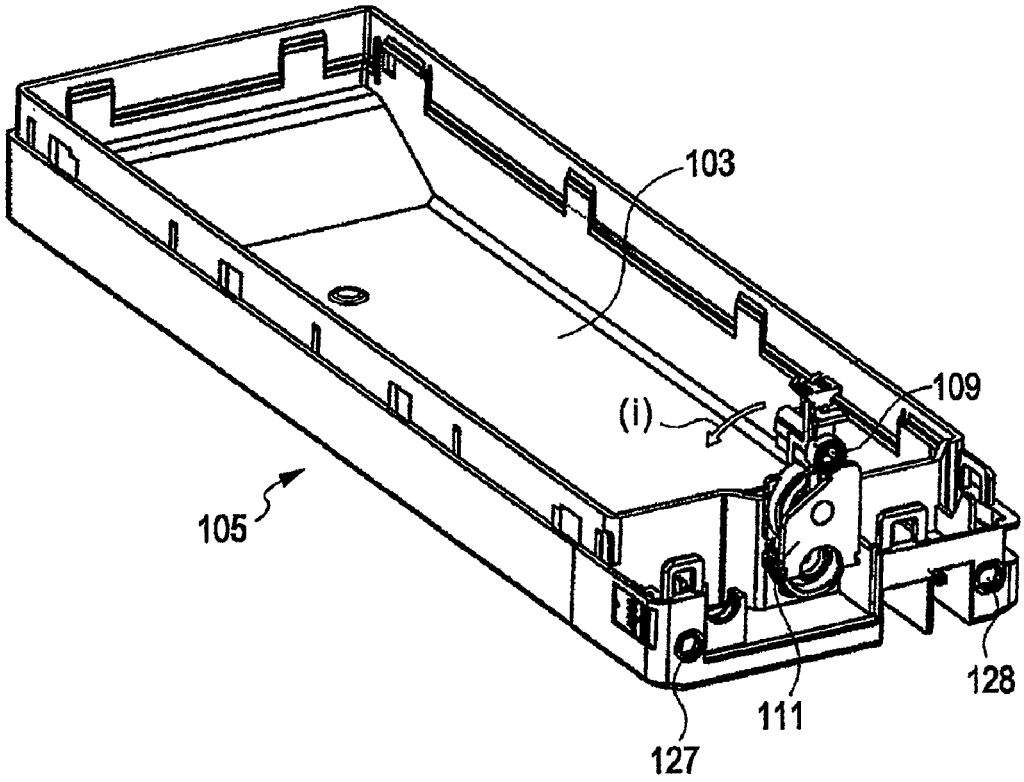
FIG. 13 is a perspective view that schematically illustrates an example of the configuration of the main body of the ink cartridge and the liquid remaining amount detection unit, the latter of which is attached to the former thereof.
Figure 14A:
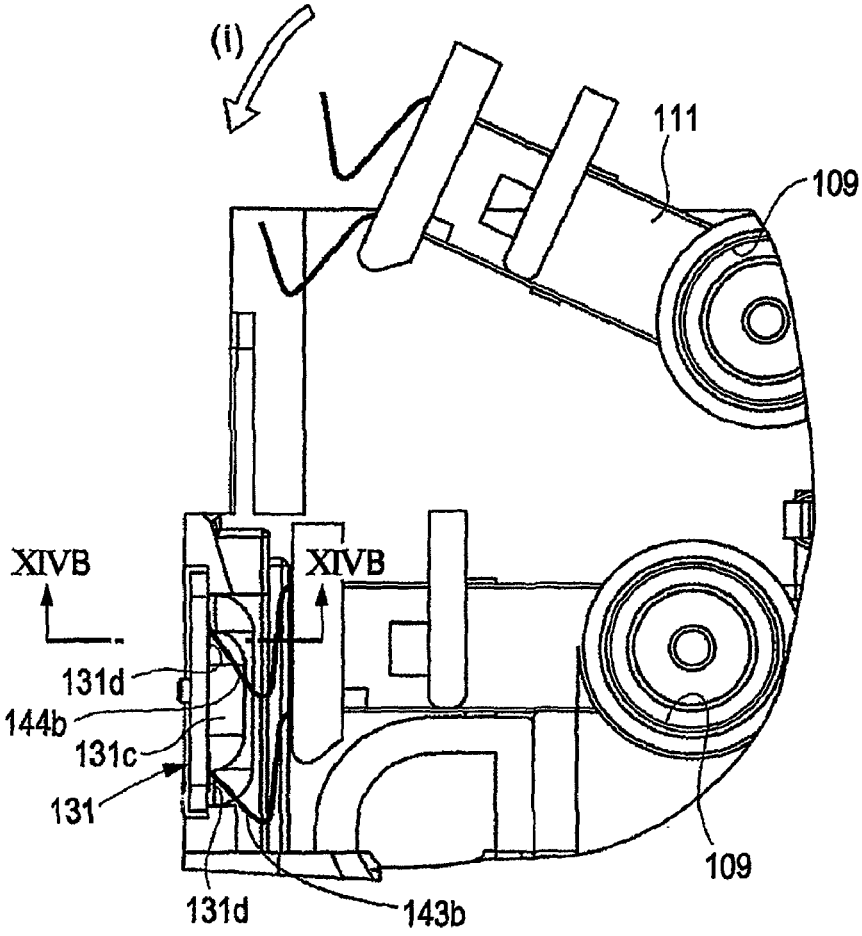
Figure 14B:
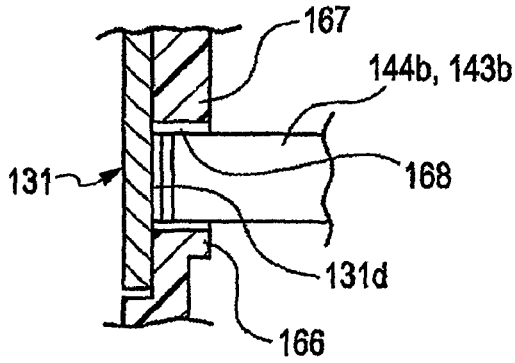
FIG. 14B is a sectional view taken along the line XIVB-XIVB of FIG. 14A.

FIG. 11 is an assembly perspective view that schematically illustrates an example of the configuration of the liquid remaining amount detection unit. FIG. 12 is a rear perspective view that schematically illustrates an example of the configuration of the liquid remaining amount detection unit, which is viewed from the reverse side thereof. FIG. 13 is a perspective view that schematically illustrates an example of the configuration of the main body of the ink cartridge and the liquid remaining amount detection unit, the latter of which is attached to the former thereof. FIG. 14A is an enlarged view that schematically shows, in a partial illustration, a circuit substrate and surrounding configuration thereof. Finally, FIG. 14B is a sectional view taken along the line XIVB-XIVB of FIG. 14A.

An ink cartridge 100 illustrated in FIG. 8 is detachably attached to the cartridge attachment portion of an ink-jet recording apparatus that is available on the market. The ink cartridge 100 supplies ink to a recording head that is provided on an ink-jet recording apparatus.

The ink cartridge 100 is provided with a container body 105, an ink pack 107, and a liquid remaining amount detection unit 111. The container main body 105 of the ink cartridge 100 has a bag-housing portion 103, which is formed as a case having an inner space. A pressure-application means applies pressure into the bag-housing portion 103. The ink pack 107 contains ink. The ink pack 107 is encased in the bag-housing portion 103. As a result of the application of pressure by the pressure-application means into the bag-housing portion 103, ink contained in the ink pack 107 is forced out through an ink outlet member 107*a*. The ink pack 107 is a non-limiting example of a fluid container of the invention. The ink outlet member 107*a* is a non-limiting example of a fluid outlet section of the invention. The liquid remaining amount detection unit 111 has another ink outlet member 109. The liquid remaining amount detection unit 111 is detachably attached to the container body 105 of the ink cartridge 100. The ink outlet member 109 is a part used for the supplying of ink to a recording head. The recording head is a non-limiting example of an external liquid consumption device.

The container body 105 of the ink cartridge 100 is a case that is molded from a resin material. The container body 105 of the ink cartridge 100 has, in addition to the above-described bag-housing portion 103, which has an open top and has a substantially box-like shape, a detection-unit housing portion 113 as a partitioned compartment thereof. The detection-unit housing portion 113 is formed at the front-face side of the bag-housing portion 103. The detection-unit housing portion 113 functions as a receptacle for the liquid remaining amount detection unit 111.

After the encasement of the ink pack 107 into the bag-housing portion 103, a sealing film 115 is adhered thereto so as to seal the open top thereof. By this means, the bag-housing portion 103 constitutes a sealed compartment.

A partition wall 105*a* constitutes a boundary between the bag-housing portion 103 and the detection-unit housing portion 113. The partition wall 105*a* has a pressure-application hole 117 formed therein. The pressure-application hole 117 of the partition wall 105*a* constitutes a part of a communication passage through which air is fed so as to pressurize the bag-housing portion 103, which is, as has already been described above, formed as a sealed compartment as a result of the adhesion of the sealing film 115 thereto. As the ink cartridge 100 is attached to the cartridge attachment portion of an ink-jet recording apparatus, a pressurization-air-supplying means that is provided on the cartridge attachment portion thereof is connected to the pressure-application hole 117. Through this connection, it is possible to feed air into the bag-housing portion 103 so as to apply pressure to the ink pack 107 placed therein.

The ink pack 107 is made up of, though not necessarily limited thereto, a flexible bag 107*b* and the above-mentioned ink outlet member 107*a*. The flexible bag 107*b* is made of a multi-layered sealing film. The ink outlet member 107*a*, which has a cylindrical shape, is adhered to one end of the flexible bag 107*b*. The insertion-joint needle 111*a* (refer to FIG. 12) of the liquid remaining amount detection unit 111 is joined with, or in other words, inserted into, the ink outlet member 107*a*.

An opening 118 is formed in the partition wall 105*a*. The opening 118 is provided so as to accommodate an insertion joint port (ink outlet member 107*a*). The ink pack 107 is encased in the bag-housing portion 103 in such a manner that the ink outlet member 107*a* of the ink pack 107 protrudes through the opening 118 in an airtight manner. With such a configuration, as illustrated in FIGS. 9A and 9B, the front end of the ink outlet member 107*a* of the ink pack 107 is protruded into the detection-unit housing portion 113. The ink outlet member 107*a* according to the present embodiment of the invention has the same configuration as that of the ink outlet member 50 (refer to FIGS. 6 and 7) according to the second embodiment of the invention. Therefore, a detailed explanation thereof is not given herein so as to omit any redundant description.

As in the configuration of the ink outlet member 50 according to the second embodiment of the invention described above, as illustrated in FIGS. 8 and 9B, a sealing film 108 is adhered to the ink outlet member 107*a* according to the present embodiment of the invention. Likewise the configuration of the ink outlet member 50 illustrated in FIGS. 6 and 7, the sealing film 108 is adhered to the open-end surface of the ink outlet member 107 and the end surface of a sealing member that is fitted inside the ink outlet member 107. The sealing member is not shown herein. Having such a configuration, a sealing structure according to the present embodiment of the invention offers the same advantageous effects as those of the aforementioned sealing structure according to the second embodiment of the invention. The sealing film 108 according to the present embodiment of the invention has the same configuration as that of the sealing film F2 according to the first and the second embodiments of the invention described above. Therefore, a detailed explanation thereof is not given herein so as to omit any redundant description.

Ink having a high degree of deaeration has been filled into the ink pack 107, which is followed by the sealing thereof by means of the sealing film 108, prior to the jointing of the liquid remaining amount detection unit 111 with the ink pack 107.

When the ink pack 107 is encased into the above-described bag-housing portion 103, spacer members 119, each of which is made of a resin, are attached to the inclined portions 107*c* and 107*d* of the ink pack 107. The inclined portions 107*c* and 107*d* of the ink pack 107 are formed at the front of the flexible bag 107*b* and the back thereof, respectively. As has already been explained above, the sealing film 115 covers the top of the bag-housing portion 103 so as to form the bag-housing portion 103 into a sealed compartment. The above-described resinous spacer members 119 securely hold the ink pack 107 so as to prevent the ink pack 107 from undesirably moving in the sealed compartment. In addition thereto, these resinous spacer members 119 fill up unwanted spaces inside the sealed compartment so as to improve the efficiency of pressurization when air is fed into the bag-housing portion 103.

A cover 121 is attached to the container body 105 of the ink cartridge 100 over the detection-unit housing portion 113 and the sealing film 115. The cover 121 has latch-projection members that are not shown in the drawing. As the cover 121 is placed at an appropriate position on the container body 105 of the ink cartridge 100 and then pressed against it, these latch-projection members engage with latch-recess members 122 formed in the container body 105 of the ink cartridge 100. By this means, the cover 121 is securely attached to the container body 105 of the ink cartridge 100.

As illustrated in FIG. 9B, a detection-unit attaching portion 123 is provided around the opening 118 that is formed in the partition wall 105*a*. The liquid remaining amount detection unit 111 can be attached to the detection-unit attaching portion 123 in accordance with a predetermined procedure.

In the configuration of the ink cartridge 100 according to the present embodiment of the invention, the detection-unit attaching portion 123 has a structure that allows the liquid remaining amount detection unit 111 to be fitted therewith in a rotatable manner. The detection-unit attaching portion 123 is formed at a position that is away from a circuit substrate 131, which is also formed on the container body 105 of the ink cartridge 100. A more detailed explanation of the circuit substrate 131 will be given later. Specifically, the detection-unit attaching portion 123 has two curved convex walls 123*a* and 123*b*. Each of these two curved convex walls 123*a* and 123*b* has an arc-shaped structure that guides the movement of the liquid remaining amount detection unit 111 in a rotational direction.

As illustrated in FIG. 9B, another partition wall 105*b* is formed in the detection-unit housing portion 113. The partition wall 105*b* is formed at a position close to the detection-unit attaching portion 123. The partition wall 105*b* is substantially orthogonal to the partition wall 105*a*. An engagement slit 124 is formed in the partition wall 105*b*. The engagement slit 124 prevents the liquid remaining amount detection unit 111, which is fitted with the detection-unit attaching portion 123, from becoming detached therefrom when it is not supposed to be.

The container body 105 of the ink cartridge 100 has a front-face wall 105*c*. The front-face wall 105*c* functions as a partition wall that covers the front-face side of the detection-unit housing portion 113. The front-face wall 105*c* has an opening 126 that is formed as a notch at a position opposite to the detection-unit attaching portion 123. The notch 126 is used for the attachment of the liquid remaining amount detection unit 111 to the detection-unit attaching portion 123.

As illustrated in FIG. 9A, two holes 127 and 128 are formed at one (left in FIG. 9A) end region and the other (right in FIG. 9A) end region of the front-face wall 105*c*, respectively. Two pins that are provided on the cartridge attachment portion are inserted into the corresponding holes 127 and 128, respectively, when the ink cartridge 100 is attached to the cartridge attachment portion. When the ink cartridge 100 is attached to the cartridge attachment portion, the movement of the ink cartridge 100 is restricted by two holes 127 and 128 and two pins, then, the ink cartridge 100 is guided to the proper position.

The aforementioned circuit substrate 131 is provided on one sidewall of the container body 105 of the ink cartridge 100 that is closer to the hole 127 than the hole 128 at a position close to the front face of the container body 105. The circuit substrate 131 becomes in a mechanical contact with connection terminals that are provided on the cartridge attachment portion when the ink cartridge 100 is attached to the cartridge attachment portion, thereby providing an electric connection therebetween. The circuit substrate 131 has a plurality of contact points that become in contact with the connection terminals that are provided on the cartridge attachment portion.

As illustrated in FIG. 14, a memory element 131*c* is provided at the rear of the circuit substrate 131. The memory element 131*c* stores information on the remaining amount of ink, the use history of the cartridge, though not limited thereto. In addition to the memory element 131*c*, a contact point 131*d* is provided on the back face of the circuit substrate 131. The contact point 131*d* electrically connects a sensor member 132 (refer to FIG. 10) to a connection terminal provided on an ink-jet recording apparatus. The sensor member 132 detects the remaining amount of liquid. The sensor member 132 is mounted in the liquid remaining amount detection unit 111. The sensor member 132 includes at least a piezoelectric element as a constituent element thereof. Although the sensor member 132 is not necessarily made up of a piezoelectric element only, it is generally and/or collectively referred to as "sensor member" herein in order to simplify explanation. As the ink cartridge 100 (refer to FIG. 8) is attached to the cartridge attachment portion of an ink-jet recording apparatus, each of contact points (not shown) provided on the surface of the circuit substrate 131 becomes in contact with the corresponding connection terminal of the cartridge attachment portion. By this means, the memory element 131*c* and the sensor member 132 are electrically connected to a control circuit that is provided in the ink-jet recording apparatus. Through the electric connection established therebetween, the control circuit of the ink-jet recording apparatus can control the operations of the memory element 131*c* and the sensor member 132.

The liquid remaining amount detection unit 111 according to the present embodiment of the invention is provided with, as illustrated in FIGS. 10 and 11, a unit case 133, the sensor member 132, an insulation sensor sealing film (not shown therein), and relay terminals 143 and 144. The unit case 133 is made of a resin material. The unit case 133 turns to be attached to the container body 105 of the ink cartridge 100 (refer to FIG. 8). The sensor member 132 is mounted to the back face of the unit case 133 with a sensor base 141 being interposed therebetween. The insulation sensor sealing film covers the exposed surface of the sensor base 141 around the sensor member 132. The relay terminals 143 and 144 are made of a pair of metal plates. The pair of metal-plate relay terminals 143 and 144 is indirectly attached to the unit case 133 with the insulation sensor sealing film being sandwiched therebetween, thereby providing an electric connection between terminals 132*a* and 132*b* of the sensor member 132 and the contact point 131*d* (refer to FIGS. 14A and 14B) formed at the back of the circuit substrate 131 (refer to FIGS. 14A and 14B).

The unit case 133 is made up of a case body 133*a*, a flow channel formation member 133*c*, a pressure chamber sealing film (not shown), and a cover member 133*b*. The case body 133*a* of the unit case 133 has the ink outlet member 109 and an inner flow channel space 146. An ink supply needle of the cartridge attachment portion is joined with, or in other words, inserted into, the ink outlet member 109. The inner flow channel space 146 is communicated with the ink outlet member 109. The flow channel formation member 133*c* is mounted inside the inner flow channel space 146. A combination of the flow channel formation member 133*c* and the inner flow channel space 146 provides a flow channel that is communicated with the ink outlet member 109. The pressure chamber sealing film is adhered to an edge face of the case body 133*a* of the unit case 133. The pressure chamber sealing film seals the open face of the inner flow channel space 146 so as to demarcate a pressure chamber that is used for detecting the remaining amount of liquid. The lid member 133*b* of the unit case 133 covers the pressure chamber sealing film so as to protect thereof.

The cover member 133*b* has a latch 151 that protrudes at the base-end region thereof. The latch 151 has a hole 151*a*. An engagement axis 152, which protrudes from the outer surface of the case body 133*a*, fits into the hole 151*a* of the latch 151. By this means, the cover member 133*b* is attached to the case body 133*a* in such a manner that it can freely turn on the case body 133*a*. The front-end region of the cover member 133*b* is joined with case body 133*a* via a coil spring 153. With such a structure, the cover member 133*b* is attached to the case body 133*a* in a movable manner.

A flow channel opening/closing valve mechanism 155 is provided inside the ink outlet member 109. The flow channel opening/closing valve mechanism 155 opens a flow channel when the ink supply needle provided at the cartridge attachment portion in the printer 11 is inserted into the ink outlet member 109. The flow channel opening/closing valve mechanism 155 is made up of a sealing member 155*a*, a valve member 155*b*, and a spring member 155*c*. The sealing member 155*a* has a cylindrical shape. The sealing member 155*a* is fitted in the ink outlet member 109. The valve member 155*a* is pressed against the sealing member 155*a* so as to keep the closed state of the flow channel. The spring member 155*c* urges the valve member 155*b* toward the sealing member 155*a* so that the valve member 155*a* is pressed against the sealing member 155*a*. Likewise the aforementioned ink outlet member 107*a*, the ink outlet member 109 according to the present embodiment of the invention has the same configuration as that of the ink outlet member 50 (refer to FIGS. 6 and 7) according to the second embodiment of the invention. Therefore, a detailed explanation thereof is not given herein so as to omit any redundant description.

A sealing film 156 seals the open end of the ink outlet member 109 to which the flow channel opening/closing valve mechanism 155 is attached. Likewise the configuration of the ink outlet member 50 according to the second embodiment of the invention described above (refer to FIGS. 6 and 7), the sealing film 156 is adhered to the open-end surface of the ink outlet member 109 and the end surface of the sealing member 155*a* that is fitted inside the ink outlet member 109. As the aforementioned ink outlet member 107*a* constitutes an ink flow channel, so does the ink outlet member 109 described herein, which is formed in the liquid remaining amount detection unit 111. Therefore, the same problem to be solved by the ink outlet member 107*a*, which is directly connected to the ink pack 107, also applies to the ink outlet member 109 described herein. The present embodiment, when applied to the ink outlet member 109 described herein, which is formed in the liquid remaining amount detection unit 111, provides a technical solution to the problem of the leakage of ink through the clearance D2 that has already been explained above with reference to FIG. 4. The sealing film 156 according to the present embodiment of the invention has the same configuration as that of the sealing film F2 according to the first and the second embodiments of the invention described above. Therefore, a detailed explanation thereof is not given herein so as to omit any redundant description.

When the ink cartridge 100 is attached to the cartridge attachment portion of an ink-jet recording apparatus, an ink supply needle that is formed on the cartridge attachment portion thereof pierces through the sealing film 156 to be inserted into the ink outlet member 109. The ink supply needle that has entered the liquid outlet member 109 presses the valve member 155*b* so that the valve member 155*b* comes away from the sealing member 155*a*. As a result thereof, the fluid channel formed in the unit case 133 becomes communicated with the ink supply needle. By this means, it becomes possible to supply ink to the ink-jet recording apparatus.

As illustrated in FIG. 12, the case body 133*a* of the unit case 133 has a container-fitting portion 135. The container-fitting portion 135 is formed on the back face of the case body 133*a* at a position corresponding to the detection-unit attaching portion 123 (refer to FIG. 9A) of the container body 105 of the ink cartridge 100. The container-fitting portion 135 is attached to the detection-unit attaching portion 123. The container-fitting portion 135 and the detection-unit attaching portion 123 can be turned with respect to each other. The insertion-joint needle 111*a*, which is joined with, or in other words, inserted into, the ink outlet member 107*a* of the ink pack 107, is formed at a position inside the container-fitting portion 135. The insertion-joint needle 111*a* pierces through the sealing film 108, which is shown in FIGS. 8 and 9B, to enter the ink outlet member 107*a* of the ink pack 107. As the insertion-joint needle 111*a* opens the valve mechanism formed in the ink outlet member 107*a*, it becomes possible to flow out ink. That is, likewise the aforementioned ink supply needle, the insertion-joint needle 111*a* functions as a fluid take-out needle according to the invention. The aforementioned flow channel that is formed by a combination of the inner flow channel space 146 and the flow channel formation member 133*c* (refer to FIGS. 10 and 11) is an inner flow channel through which the ink outlet member 109 is communicated with the insertion-joint needle 111*a*.

The sensor member 132 is a piezoelectric sensor that is mounted on the back face of the case body 133*a* so as to be able to apply vibration to the inner flow channel thereof. The sensor member 132 outputs, in the form of an electric signal, a change in residual vibration in accordance with a change in the amount of ink in the inner flow channel. The control circuit provided in the ink-jet recording apparatus analyzes the output signal of the sensor member 132. By this means, the amount of ink remaining in the ink pack 107 is detected.

In the configuration of the ink cartridge 100 according to the present embodiment of the invention, the container-fitting portion 135 formed on the case body 133*a* of the unit case 133 of the liquid remaining amount detection unit 111 has two curved convex walls 135*a* and 135*b* that are attached to the aforementioned two curved convex walls 123*a* and 123*b* of the detection-unit attaching portion 123, respectively. As has already been described above, the container-fitting portion 135 and the detection-unit attaching portion 123 are joined with each other in such a manner that they can be turned with respect to each other. These two curved convex walls 135*a* and 135*b*, each of which has an arc-shaped structure, guide the movement of the liquid remaining amount detection unit 111 in a rotational direction.

At a peripheral region of the container-fitting portion 135 formed on the case body 133*a*, an engagement member 138 is provided. When the liquid remaining amount detection unit 111 is turned in a direction shown by an arrow (i) in FIG. 13 from an initial state where the container-fitting portion 135 and the detection-unit attaching portion 123 (refer to FIG. 9A) are joined with each other, the engagement member 138 engages with the aforementioned engagement slit 124 (refer to FIG. 9B), which is formed in the container body 105 of the ink cartridge 100, so as to prevent the otherwise possible detachment of the container-fitting portion 135 from the detection-unit attaching portion 123.

As illustrated in FIG. 10 as well as FIGS. 14A and 14B, the pair of metal-plate relay terminals 143 and 144 is attached to the case body 133*a* of the unit case 133 in such a manner that one ends 143*a* and 144*a* thereof are in contact with the terminals 132*a* and 132*b* of the sensor member 132 that is attached to the unit case 133 respectively whereas the other ends 143*b* and 144*b* thereof are in contact with the contact points 131*d* and 131*d* formed at the back of the circuit substrate 131 respectively. With such a configuration, the pair of relay terminals 143 and 144 electrically connects the sensor member 132 to the circuit substrate 131.

That is, the pair of relay terminals 143 and 144 is attached to the case body 133*a* of the unit case 133 in such a manner that the above-mentioned one ends 143*a* and 144*a* thereof are in mechanical contact with, and thus electrically connected to, the terminals 132*a* and 132*b* of the sensor member 132 that is attached to the unit case 133, respectively. On the other hand, the unit case 133 supports the other ends 143*b* and 144*b* of the pair of relay terminals 143 and 144 in such a manner that they are allowed to move along the direction of a rotation axis around which the liquid remaining amount detection unit 111 is turned so as to attach the liquid remaining amount detection unit 111 to the container body 105 of the ink cartridge 100. The rotation axis direction is denoted as (ii) and shown by a double-headed arrow in FIG. 11.

Contact pieces 143*c* and 144*c* are formed as a part of the above-mentioned one ends 143*a* and 144*a* of the pair of relay terminals 143 and 144. The contact pieces 143*c* and 144*c* contact the terminals 132*a* and 132*b* of the sensor member 132, respectively. A fixation hole 161 and a fixation hole 162 are formed in each of the above-mentioned one ends 143*a* and 144*a* of the pair of relay terminals 143 and 144. These fixation holes 161 and 162 are press-fitted with bosses (not shown) that protrude on the case body 133*a*. As the bosses are press-fitted into the fixation holes 161 and 162, the pair of relay terminals 143 and 144 is fixed to the case body 133*a* of the unit case 133.

On the other hand, as illustrated in FIG. 11, slits 164 determine the positions of the above-mentioned other ends 143*b* and 144*b* of the pair of relay terminals 143 and 144. Each of these slits 164 is formed at an end of the case body 133*a*. Each of these slits 164 is elongated along the direction of the above-described rotation axis around which the liquid remaining amount detection unit 111 is turned so as to attach the liquid remaining amount detection unit 111 to the container body 105 of the ink cartridge 100. With such a configuration, each of the above-mentioned other ends 143*b* and 144*b* of the pair of relay terminals 143 and 144 is supported in such a manner that it is able to move in the direction in which the rotation axis extends, which is denoted as (ii) and shown by the double-headed arrow in FIG. 11.

As illustrated in FIG. 14B, a pair of guide ribs 166 and 167 is formed near a position at which the circuit substrate 131 is provided on the container body 105 of the ink cartridge 100. These guide ribs 166 and 167 function as a position-adjusting means that adjusts the positions of the above-mentioned other ends 143*b* and 144*b* of the pair of relay terminals 143 and 144 into the position of the contact point 131*d*. The pair of guide ribs 166 and 167 constitutes a slit 168 through which each of the above-mentioned other ends 143*b* and 144*b* of the pair of relay terminals 143 and 144 can pass.

As illustrated in FIG. 10, an elastic means 171 is provided in each of the above-mentioned other ends 143*b* and 144*b* of the pair of relay terminals 143 and 144. The elastic means 171 makes it possible for each of the above-mentioned other ends 143*b* and 144*b* of the pair of relay terminals 143 and 144 to be elastically deflected toward the rotation axis when the liquid remaining amount detection unit 111 is turned so as to attach the liquid remaining amount detection unit 111 to the container body 105 of the ink cartridge 100. The elastic means 171 is a bended portion of each of the relay terminals 143 and 144 that is formed through the press-forming process thereof. At a region interposed between the fixation holes 161 and 162 of each of the above-mentioned one ends 143*a* and 144*a* of the pair of relay terminals 143 and 144, a reduced-area portion 173 is formed. The reduced-area portion 173 extends along the longitudinal direction of each of the relay terminals 143 and 144. Having a folded structure, the reduced-area portion 173 increases the rigidity of each of the pair of the relay terminals 143 and 144. Each of the relay terminals 143 and 144 is a press-molded metal plate. The reduced-area portion 173 is formed through the press-forming process thereof.

The ink cartridge 100 according to the present embodiment of the invention is assembled as follows.

As a first step, as illustrated in FIG. 13, the liquid remaining amount detection unit 111 is fitted into the detection-unit attaching portion 123 of the container body 105 in such a state where the liquid remaining amount detection unit 111 is vertically erected thereon. As a next step, as illustrated in FIG. 14, the liquid remaining amount detection unit 111 is turned in the direction shown by the arrow (i) in FIG. 13 from the initial erected state where the container-fitting portion 135 and the detection-unit attaching portion 123 are joined with each other. By this means, the above-mentioned other ends 143*b* and 144*b* of the pair of relay terminals 143 and 144 that protrude at the end of the liquid remaining amount detection unit 111 become in contact with the contact points 131*d* and 131*d* formed at the back of the circuit substrate 131. In this way, the liquid remaining amount detection unit 111 is attached to the container body 105 of the ink cartridge 100.

Thereafter, as illustrated in FIGS. 8 and 9, the ink pack 107 is placed into the bag-housing portion 103 of the container body 105. The insertion-joint needle 111*a* (refer to FIG. 12) of the liquid remaining amount detection unit 111 pierces through the sealing film 108 to enter the ink outlet member 107*a* of the ink pack 107. When the ink pack 107 is encased into the bag-housing portion 103, the aforementioned spacer members 119 are attached onto the inclined portions 107*c* and 107*d* of the ink pack 107. Next, the sealing film 115 is adhered to the top of the bag-housing portion 103 by means of a thermal adhesion or the like so as to form the bag-housing portion 103 into a sealed compartment. As a final step of the assembly of the ink cartridge 100, the cover 121 is attached to the container body 105 thereof over (the detection-unit housing portion 113 and) the sealing film 115.

When the ink cartridge 100 is attached to the cartridge attachment portion of an ink-jet recording apparatus, an ink supply needle that is formed on the cartridge attachment portion thereof pierces through the sealing film 156 to be inserted into the ink outlet member 109. By this means, it becomes possible to supply ink from the ink cartridge 100 to the recording head.

Thanks to the sealing films 108 and 156, the ink cartridge 100 according to the present embodiment of the invention offers the same advantageous effects as those of the aforementioned sealing structure according to the second embodiment of the invention. Moreover, likewise the second embodiment of the invention, modification examples given in the description of the first embodiment of the invention are also applicable to the present embodiment of the invention except that it is not necessary to block or cover the clearance D1.

In the attachment configuration of the present embodiment of the invention, it is explained that the liquid remaining amount detection unit 111 is turned so as to attach the liquid remaining amount detection unit 111 to the container body 105 of the ink cartridge 100. However, the attachment structure that can be adopted in the invention is not limited to the turn-attachment structure described above. Any modified attachment structure may be adopted in place of the specific example described above as long as it is simple enough to be adopted alternatively. As a non-limiting modification example thereof, it is possible to vertically slide the liquid remaining amount detection unit 111 so as to attach it to the container body 105 of the ink cartridge 100.

Fourth Embodiment

In the fourth embodiment of the invention, the novel and inventive features of an ink cartridge according to the invention including its unique sealing structure described above is applied to a refilled fluid container. Ink cartridge suppliers attempt to collect used ink cartridges from consumers and refill ink into the empty ink pack 107 of each of the returned ink cartridges 100 for reuse or recycle thereof.

The collected ink cartridge 100 after use is disassembled as illustrated in FIG. 8. Then, ink is refilled into the empty ink pack 107. The sealing film 108 illustrated in FIG. 8 has been broken because an ink take-out needle has pierced through it as shown in FIG. 5. The same holds true for the sealing film 156 illustrated in FIG. 10. However, the peripheral region of the sealing film 108 around the broken central region thereof remains adhered to the ink outlet member 107*a* and the sealing member fitted inside thereof. Therefore, sealing property is retained at the peripheral region of the sealing film 108 of the collected ink cartridge 100. Likewise the sealing film 108, the peripheral region of the sealing film 156 around the broken central region thereof remains adhered to the ink outlet member 109 and the sealing member fitted inside thereof. Therefore, sealing property is retained at the peripheral region of the sealing film 156 of the collected ink cartridge 100. In addition, it is very hard and thus almost practically impossible to remove the sealing film 108 and the sealing film 156 once after they are subjected to a thermal adhesion process.

Figure 15:
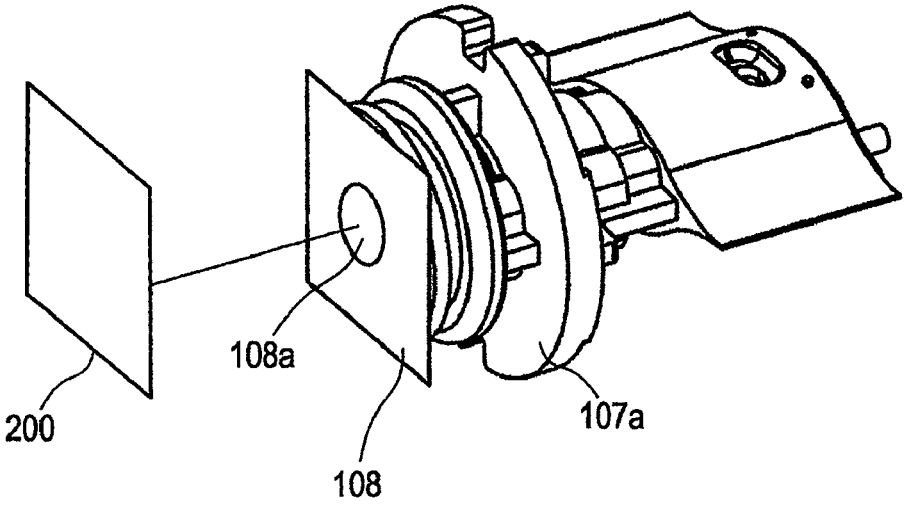
FIG. 15 is a perspective view that schematically illustrates an exemplary method of sealing an ink outlet member to be recycled or reused as a fourth embodiment of the invention.

Therefore, as illustrated in FIG. 15, an overcoat film 200 is provided to overlie the sealing film 108 that partially remains adhered to the ink outlet member 107*a* in such a manner that the overcoat film 200 covers the broken middle region 108*a*, though not limited thereto, of the sealing film 108. Then, the overcoat film 200 is adhered to the partially broken sealing film 108 so as to cover the broken middle region 108*a* thereof. By this means, the overcoat film 200 that is adhered to the partially broken sealing film 108 prevents any ink from leaking through the broken region 108*a* thereof. In addition thereto, it is possible to guarantee the commercial value of the ink cartridge 100 as recycled goods because the broken region 108*a* is not exposed to the outside. In this context, the adhesion of the overcoat film 200 to the partially broken sealing film 108 may be thermal one or non-thermal one, the latter of which includes but not limited to bonding. In a case where the overcoat film 200 is thermally adhered to the partially broken sealing film 108, the material of the overcoat film 200 should be the same as that of the sealing film 108. On the other hand, in a case where the overcoat film 200 is non-thermally adhered to the partially broken sealing film 108, there is no such restriction. That is, if the overcoat film 200 is adhered to the partially broken sealing film 108 by means of a non-thermal adhesion method, any alternative material may be adopted as long as it has a thin film shape and can prevent the leakage of ink through the broken region 108*a* thereof. A few non-limiting examples of the material of the overcoat film 200 are, in addition to the above-described resin material, a fibrous material (i.e., textile material) such as paper or cloth, non-woven paper, or non-woven cloth.

Figure 16:
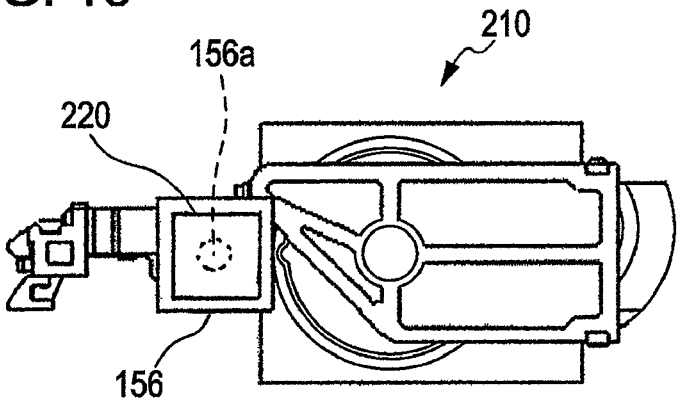
FIG. 16 is a front view that schematically illustrates an example of the configuration of a liquid remaining amount detection unit to be recycled or reused.

In the same manner as explained above, an overcoat film is adhered to the partially broken sealing film 156. FIG. 16 is a diagram that schematically illustrates an example of the configuration of a recycled liquid remaining amount detection unit 210, which has an appearance different from that of the liquid remaining amount detection unit 111 shown in FIGS. 10, 11, and 12. In the configuration of the recycled liquid remaining amount detection unit 210, an overcoat 220 is adhered, either thermally or non-thermally, to the partially broken sealing film 156 so as to cover the broken region 156*a* thereof.

As explained above, a reproduction technique according to the present embodiment of the invention makes it possible to recycle the ink cartridge 100 according to the third embodiment of the invention as a refilled ink cartridge while reusing the retained sealing property of the sealing films 108 and 156, which is achieved by just adhering, either thermally or non-thermally, the overcoat films 200 and 220 to the partially broken sealing films 108 and 156, respectively. A reproduction technique according to the present embodiment of the invention makes it further possible to guarantee the commercial value of a refill fluid container made of a collected fluid container as recycled goods because the broken region of the sealing film 108, 156 thereof is not exposed to the outside.

It should be noted that a reproduction technique according to the present embodiment of the invention described above in which, after the refilling of ink into a used and collected ink cartridge, an overcoat film is adhered to a partially broken sealing film is also applicable to the first and second embodiments of the invention described above. Specifically, ink is refilled into the empty ink pack 32 of the used and collected ink cartridge 23 according to the first and second embodiments of the invention. Thereafter, an overcoat film that is equivalent to (i.e., the same as or similar to) the overcoat films 200 and 220 described above is adhered to the partially broken sealing film F2. By this means, it is possible to recycle, likewise the ink cartridge 100 according to the third embodiment of the invention, the used and collected ink cartridge 23 according to the first and second embodiments thereof as a refilled ink cartridge while reusing the retained sealing property thereof.

Fifth Embodiment

Figure 17:
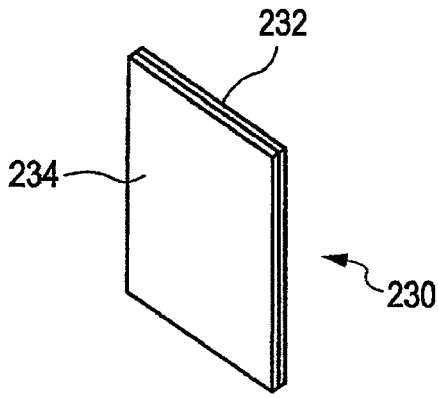
FIG. 17 is a perspective view that schematically illustrates an example of the configuration of an overcoat film that is made up of a plurality of layers according to a fifth embodiment of the invention.

The fifth embodiment of the invention discloses a variation example of the configuration of a sealing film. The variation example of the configuration of a sealing film described herein is applicable to any of the sealing films F2, 108, and 156 described above. A sealing film 230 according to the variation example of the invention described herein has a multilayer structure. As shown in FIG. 17, for example, it may be configured as a dual-layer film. In the configuration of the dual-layer sealing film 230, a first layer film 232, which faces an ink outlet member, is made of the above-described material that is easy to be thermally adhered to the ink outlet member, a sealing member, and a case body. Any material may be used for a second layer film 234, which is at the opposite face thereof, as long as it has a melting point that is higher than that of the first layer film 232. Having such a configuration, the dual-layer sealing film 230 can retain its shape even after it is subjected to a thermal adhesion process because the second layer film 234 thereof does not melt at a certain temperature at which the first layer film 232 thereof melts. Assuming that the first layer film 232 of the dual-layer sealing film 230 is made of polypropylene or polyethylene, or any equivalent thereof, it is preferable that the second layer film 234 thereof should be made of polyethylene terephthalate (PET) or polyimide (PA). Since the sealing film 230 made of the preferred material described above does not stretch easily at the time of the piercing of an ink take-out needle therethrough, it is possible to easily penetrate the ink take-out needle therethrough.

Although a detailed explanation is given above while describing exemplary embodiments of the invention, a person skilled in the art can easily understand that the invention is in no case restricted to these exemplary embodiments described herein and that the invention may be modified, altered, changed, adapted, and/or improved within a range not departing from the gist and/or spirit of the invention, including its novel and inventive features as well as unique advantageous effects thereof, as apprehended from explicit and implicit description made herein. Such a modification, an alteration, a change, an adaptation, and/or an improvement are also covered by the scope of the appended claims. For example, it should be understood that any term that is paraphrased or generalized into other term, phrase, or expression having an equivalent or broader meaning at least once in this specification and/or the accompanying drawings can be replaced by the abovementioned other term, phrase, or expression anywhere in this specification and/or the accompanying drawings with no adverse effect of restricting the scope of the invention in any case.

The application of a sealing structure and a fluid container according to the invention is not limited to an ink cartridge of an ink-jet recording apparatus. It can be also applied to a variety of liquid consumption apparatuses that is provided with a liquid ejecting head.

Examples of a liquid consumption apparatus that is provided with a liquid ejecting head to which the invention is applicable include, without any limitation thereto: an apparatus that has a color material ejection head that is used in the production of a color filter for a liquid crystal display device or the like; an apparatus that has an electrode material (i.e., conductive paste) ejection head that is used for electrode formation for an organic EL display device, a surface-emitting display device (FED), and the like; an apparatus that has a living organic material ejection head that is used for production of biochips; an apparatus that has a sample ejection head that functions as a high precision pipette; a textile printing apparatus; and a micro dispenser, in addition to the ink-jet recording apparatus described above.

The entire disclosure of Japanese Patent Application Nos: 2007-37993, filed Feb. 19, 2007 and 2007-132728, filed May 18, 2007 are expressly incorporated by reference herein.

What is claimed is:

1. A fluid container comprising:

a fluid-containing bag containing fluid;

a fluid outlet section being communicated with the fluid-containing bag, the fluid outlet section having a fluid flow channel and an open-end surface, the open-end surface being formed at a fluid outlet end of the fluid flow channel;

a sealing member provided in the fluid flow channel; and a sealing film covering the fluid flow channel and the open-end surface, the sealing film being thermally adhered to the open-end surface of the fluid outlet section and the sealing member, wherein the sealing member includes a first adhesion allowance portion that protrudes in a ring shape and is thermally adhered to the sealing film.

2. The fluid container according to claim 1, wherein the fluid flow channel admits a fluid take-out needle to enter the fluid flow channel with piercing the sealing film, and the sealing member comprises an elastic ring that has a hole portion through which the fluid take-out needle is inserted in tight contact therewith.

3. The fluid container according to claim 2, further comprising:

a movable valve member that is provided in the fluid flow channel, the movable valve member contacting with the sealing member when the fluid take-out needle is not inserted into the fluid flow channel; and an urging member that urges the valve member to press the valve member against the sealing member, wherein the sealing member functions as a valve seat member that blocks the fluid flow channel when the fluid take-out needle is not inserted into the fluid flow channel; and when the fluid take-out needle is inserted into the fluid flow channel, the valve member is pressed by the fluid take-out needle and comes away from the sealing member against the urging force applied from the urging member thereto so that the fluid flow channel is opened.

4. The fluid container according to claim 1, wherein the open-end surface includes a second adhesion allowance portion that protrudes in a ring shape, and the first adhesion allowance portion and the second adhesion allowance portion are thermally adhered to the sealing film.

5. The fluid container according to claim 1, wherein an outer surface of the sealing member contacts an inner-wall surface of the fluid flow channel so that a position of the sealing member is determined to the fluid flow channel.

6. The fluid container according to claim 1, wherein the fluid outlet section, the sealing member, and the sealing film comprise a polyolefin material.

7. The fluid container according to claim 6, wherein the polyolefin material is polypropylene.

8. The fluid container according to claim 6, wherein the polyolefin material is polyethylene.

9. The fluid container according to claim 6, wherein the sealing film comprises a plurality of layers of different materials; and an outermost layer of the plurality of layers, that faces the fluid outlet section and the sealing member is made of the polyolefin material.

10. The fluid container according to claim 9, wherein an another layer, that is adjacent to the outermost layer of the plurality of layers, is made of a material that has a melting point higher than that of the polyolefin material.

11. The fluid container according to claim 10, wherein the another layer contains polyethylene terephthalate.

12. The fluid container according to claim 10, wherein the another layer contains polyamide.

13. The fluid container according to claim 6, wherein the sealing film comprises a thermoplastic elastomer that contains the polyolefin material.

14. The fluid container according to claim 1, further comprising:

a case having a space into which the fluid-containing bag and the fluid outlet section are placed;

a pressure application hole through which pressurization fluid is fed to press the fluid-containing bag and makes a fluid contained in the fluid-containing bag flow out; and an opening through which the open-end surface of the fluid outlet section is exposed, wherein the sealing film is thermally adhered further to the case at the periphery of the opening.

15. The fluid container according to claim 1, further comprising a fluid remaining amount detection unit disposed between the fluid-containing bag and the fluid flow-out section, wherein the fluid flow-out section being communicated with the fluid-containing bag via the fluid remaining amount detection unit.

16. The fluid container according to claim 1, at least a part of the sealing film has been broken, and an overcoat film is laid over and adhered to the sealing film to cover the part of the sealing film.

17. A method for manufacturing the fluid container according to claim 1, comprising steps of:

inserting the sealing member into the fluid outlet section from a side of the open-end surface;

after the step of inserting, providing the sealing film to cover the fluid flow channel and the open-end surface; and after the step of providing, thermally adhering the sealing film to the open-end surface of the fluid outlet section and the sealing member.

18. The method according to claim 17, wherein, in the step of inserting, an outer surface of the sealing member contacts an inner-wall surface of the fluid flow channel so that a position of the sealing member is determined to the fluid flow channel.

19. A method for manufacturing the fluid container according to claim 4, comprising steps of:

inserting the sealing member into the fluid outlet section from a side of the open-end surface, so that the first adhesion allowance portion and the second adhesion allowance portion are substantially on one plane;

after the step of inserting, providing the sealing film to cover the fluid flow channel and the open-end surface; and after the step of providing, thermally melting the first and the second adhesion allowance portions and adhering to the sealing film.

20. A method for manufacturing the fluid container according to claim 16 comprising steps of;

filling fluid into the fluid-containing bag though the broken sealing film; and after the step of filling, adhering an overcoat film to the sealing film.

21. The fluid container according to claim 1, wherein the first adhesion allowance portion is provided on a top surface of the sealing member.

* * * * *

UNITED STATES PATENT AND TRADEMARK OFFICE

CERTIFICATE OF CORRECTION

PATENT NO. : 8,322,835 B2
APPLICATION NO. : 12/033394
DATED : December 4, 2012
INVENTOR(S) : Aoki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 919 days.

Signed and Sealed this
Sixteenth Day of December, 2014

Michelle K. Lee

Michelle K. Lee
*Deputy Director of the United States Patent and Trademark Office*